US011503396B2

(12) United States Patent
Sandanger et al.

(10) Patent No.: US 11,503,396 B2
(45) Date of Patent: Nov. 15, 2022

(54) EARPIECE

(71) Applicant: Sectio Aurea AS, Oslo (NO)

(72) Inventors: Vidar Sandanger, Oslo (NO); Johan Sundkvist, Oslo (NO); Henrik Myhre-Sandmark, Oslo (NO)

(73) Assignee: Sectio Aurea AS

( * ) Notice: Subject to any disclaimer, the term of this patent is extended or adjusted under 35 U.S.C. 154(b) by 0 days.

(21) Appl. No.: 17/412,747

(22) Filed: Aug. 26, 2021

(65) Prior Publication Data

US 2021/0392425 A1 Dec. 16, 2021

Related U.S. Application Data

(63) Continuation of application No. 16/978,077, filed as application No. PCT/EP2019/087158 on Dec. 30,
(Continued)

(30) Foreign Application Priority Data

Apr. 23, 2019 (EP) ..... 19170641
Apr. 23, 2019 (GB) ..... 1905656
Apr. 23, 2019 (NO) ..... 20190532

(51) Int. Cl.
*H04R 25/00* (2006.01)
*H04R 1/10* (2006.01)

(52) U.S. Cl.
CPC ..... *H04R 1/1016* (2013.01); *H04R 1/105* (2013.01); *H04R 25/652* (2013.01)

(58) Field of Classification Search
CPC .... H04R 1/1016; H04R 1/105; H04R 1/1066; H04R 2420/07; H04R 1/02; H04R 1/1083;
(Continued)

(56) References Cited

U.S. PATENT DOCUMENTS 3,935,401 A 1/1976 Shore et al.
7,986,803 B1 7/2011 DeKalb
(Continued)

FOREIGN PATENT DOCUMENTS

EP 2192789 A2 6/2010
EP 2878135 A1 6/2015
(Continued)

OTHER PUBLICATIONS

Extended European Search Report with Written Opinion for Application No. 19170641.5 dated Jun. 26, 2019, 7 pages.
(Continued)

*Primary Examiner* — Amir H Etesam
(74) *Attorney, Agent, or Firm* — Lerner, David, Littenberg, Krumholz & Mentlik, LLP

(57) ABSTRACT

The present disclosure relates to an earpiece for an ear. The ear comprises a concha cavity at least partially delimited by a concha floor, a concha side wall and a concha ceiling. The earpiece comprises a peripheral skirt comprising a positioning skirt portion which in turn comprises an outer skirt surface and an inner skirt surface, wherein a transition from the outer skirt surface to the inner skirt surface occurs at a skirt edge. The skirt edge extends at least partially circumferentially around a central axis of the earpiece, wherein the earpiece is adapted to be moved to a use position, at least partially within the concha cavity, in a direction parallel to the central axis, during insertion of the earpiece into the ear. When the peripheral skirt is in a non-influenced condition, at least a portion of the inner skirt surface faces the central axis.

20 Claims, 12 Drawing Sheets

Related U.S. Application Data

2019, now Pat. No. 11,122,353, which is a continuation of application No. 16/392,597, filed on Apr. 23, 2019, now Pat. No. 10,820,085.

(58) Field of Classification Search
CPC ..... H04R 1/1091; H04R 25/00; H04R 25/02; H04R 5/033
See application file for complete search history.

(56) References Cited

U.S. PATENT DOCUMENTS

| | | | |
|---|---|---|---|
| 2004/0052389 | A1 | 3/2004 | Berg |
| 2005/0008180 | A1 | 1/2005 | Smith et al. |
| 2009/0285436 | A1 | 11/2009 | Lowry |
| 2010/0027824 | A1 | 2/2010 | Atamaniuk et al. |
| 2010/0278364 | A1 | 11/2010 | Berg |
| 2014/0037123 | A1 | 2/2014 | Tan et al. |
| 2014/0105431 | A1 | 4/2014 | Berg |
| 2014/0286515 | A1 | 9/2014 | Bone et al. |
| 2015/0215693 | A1 | 7/2015 | Sandanger |
| 2015/0281819 | A1 | 10/2015 | Silvestri et al. |
| 2015/0281822 | A1 | 10/2015 | Berg |
| 2015/0312665 | A1 | 10/2015 | Berg |
| 2016/0205456 | A1 | 7/2016 | Berg |
| 2018/0035192 | A1 | 2/2018 | Houle |
| 2018/0167713 | A1 | 6/2018 | Chou et al. |
| 2018/0213315 | A1* | 7/2018 | Kirkpatrick ..... H04R 1/1066 |
| 2018/0332380 | A1 | 11/2018 | Berg |
| 2019/0200112 | A1 | 6/2019 | Briggs et al. |

FOREIGN PATENT DOCUMENTS

| | | | |
|---|---|---|---|
| GB | 2220819 | A | 1/1990 |
| JP | 2010530659 | A | 9/2010 |
| WO | 2002045390 | A1 | 6/2002 |
| WO | 2004068896 | A2 | 8/2004 |
| WO | 2008147215 | A1 | 12/2008 |
| WO | 2009143055 | A1 | 11/2009 |
| WO | 2010127265 | A2 | 11/2010 |
| WO | 2014017922 | A1 | 1/2014 |
| WO | 2017183027 | A1 | 10/2017 |
| WO | 2018058879 | A1 | 4/2018 |

OTHER PUBLICATIONS

GB Search Report for Application No. 1905656.3 dated Jul. 11, 2019, 3 pages.

Norwegian Search Report for Application No. 20190532 dated Aug. 23, 2019, 7 pages.

International Search Report with Written Opinion for Application No. PCT/EP2019/087158 dated Jan. 17, 2020, 13 pages.

"Samsung Gear IconX 2018 headphones Review," by Rado Slavov, Nov. 28, 2017, downloaded from the internet Jun. 7, 2021 (https://www .phonearena.com/reviews/Samsung-Gear -IconX-2018-Wireless-Headphones-Biuetooth-Review_id4445); 7 pages.

"Raybird Run wireless headphones Review," by John Velasco, Nov. 28, 2017, downloaded form the internet Jun. 7, 2021 (https//www.phonearena.com/reviews/Jaybird Run-Wireless-Headphones-Bluetooth_Review Id4445); 13 pages.

"Sony WF-1000X wireless headphones Review," by John Velasco, Dec. 28, 2017; downloaded from the internet Jun. 7, 2021 (https://www .phonearena.com/reviews/Sony-WF-wireless-Headphones-Biuetooth-Review_id4445); 7 pages.

Office Action for U.S. Appl. No. 17/468,666 dated Aug. 16, 2022. 15 pgs.

* cited by examiner

EARPIECE

CROSS-REFERENCE TO RELATED APPLICATIONS

This application is a continuation of U.S. application Ser. No. 16/978,077, filed on Sep. 3, 2020, which is a national phase entry under 35 U.S.C. § 371 of International Application No. PCT/EP2019/087158, filed on Dec. 30, 2019, published in English, which claims priority to Norway Patent Application No. 20190532, filed on Apr. 23, 2019, European Patent Application No. 19170641.5, filed on Apr. 23, 2019, Great Britain Patent Application No. 1905656.3, filed on Apr. 23, 2019, and U.S. application Ser. No. 16/392,597, filed on Apr. 23, 2019, the disclosures of all of which are hereby incorporated herein by reference.

TECHNICAL FIELD

The present disclosure relates to an earpiece for an ear.

BACKGROUND

An earpiece for an ear may be used in many applications. For instance, an earpiece may be used as an earplug for protecting a user's ears from loud noises. Another application for an earpiece is when the earpiece constitutes, or at least forms part of, an earphone arrangement. For instance, an earpiece may comprise sound emitting means, such as a loudspeaker, adapted to direct sound into the ear canal of the ear.

Irrespective of the intended use of an earpiece, it is generally desired that the earpiece is such that it is kept in place relative to a user's ear. An example of such an earpiece is presented in WO 2008/147215 A1. Although the earpiece disclosed in WO 2008/147215 A1 is suitable for many applications, there is still a need for improving the design of the earpiece.

SUMMARY

An object of the present disclosure is to provide an earpiece that can be kept in place relative to a user's ear and which earpiece is also comfortable to use.

The above object is achieved by an earpiece in accordance with claim 1.

As such, the present disclosure relates to an earpiece for an ear. The ear comprises a concha cavity at least partially delimited by a concha floor, a concha side wall and a concha ceiling, wherein the concha side wall connects the concha floor to the concha ceiling. The surface of the concha ceiling has a normal at least a component of which being directed towards the concha floor.

The earpiece comprises a peripheral skirt comprising a positioning skirt portion which in turn comprises an outer skirt surface and an inner skirt surface, wherein a transition from the outer skirt surface to the inner skirt surface occurs at a skirt edge. Purely by way of example, each one of the outer skirt surface and the inner skirt surface terminates at the skirt edge.

The skirt edge extends at least partially circumferentially around a central axis of the earpiece. The earpiece is adapted to be moved to a use position, at least partially within the concha cavity, in a direction parallel to the central axis, during insertion of the earpiece into the ear.

When the peripheral skirt is in a non-influenced condition, at least a portion of the inner skirt surface faces the central axis. As used herein, the expression "non-influenced condition" is intended to mean that the peripheral skirt is not in the use position or in another condition, such as in a condition in which the positioning skirt portion is in the process of being at least partially inserted into the concha cavity, in which the peripheral skirt is imparted external loads.

According to the present disclosure, the earpiece is such that the positioning skirt portion is adapted to assume the use position at least partially within the concha cavity whereby:

- at least a portion of the outer skirt surface abuts at least a portion of the concha ceiling,
- the skirt edge is located closer to the concha floor than the outer skirt surface, and
- the skirt edge is spaced from the concha floor.

As such, the earpiece according to the present disclosure comprises a positioning skirt portion that can assist in maintaining the position of the earpiece relative to an ear, by virtue of the outer skirt surface. Moreover, the fact that the skirt edge is spaced from the concha floor of the ear during use implies a comfortable use condition. Thus, the earpiece in accordance with the present disclosure implies the combination of an appropriately durable connection between the earpiece and the ear at the same time as an appropriately comfortable use position can be obtained.

For instance, by virtue of the fact that the skirt edge does not contact the concha floor, air may be circulated between the concha floor and edge which in turn implies a desired comfort for the user. Put differently, the earpiece according to the present disclosure implies an appropriately low footprint on the concha floor.

Furthermore, the feature that at least a portion of the inner skirt surface faces the central axis in a non-influenced condition implies that at least a portion of the positioning skirt portion is slanted. This in turn implies that at least a portion of the positioning skirt portion may be deflected in a straightforward manner by a user when the positioning skirt portion is to assume the use position. The fact that at least a portion of the positioning skirt portion is slanted implies that this portion may be deflected by means of bending towards the central axis. When the positioning skirt portion is approaching the use position, the positioning skirt portion may be relaxed and move towards its non-influenced condition which implies an appropriate contact between the outer skirt surface and the concha ceiling. Moreover, the above-mentioned relaxation of the positioning skirt portion may also imply an appropriate contact between the skirt edge and the concha side wall, which in turn may assist in preventing the skirt edge from contacting the concha floor.

Optionally, the skirt edge is a free skirt edge. By the term "free skirt edge", it is meant that no additional component of the earpiece is located between the skirt edge and the concha floor when the earpiece is in the use position. The feature that the skirt edge is a free skirt edge can be used in any embodiment of the present disclosure and in each one of the appended claims.

Optionally, the above-mentioned transition from the outer skirt surface to the inner skirt surface occurring at the skirt edge is such that the portions of the inner and outer skirt surfaces, respectively, adjacent to the skirt edge form an angle of at least 120°, preferably at least 150°, to each other, as seen in a plane defined by the central axis and a radial axis being perpendicular to the central axis. The above feature relating to adjacent portions to the edge can be used in any embodiment of the present disclosure and in each one of the appended claims.

Optionally, the skirt edge may have a radius of curvature within the range of 0.1-3 mm, preferably within a range of 0.5-2 mm, as seen in a plane defined by the central axis and a radial axis being perpendicular to the central axis. The above feature relating to the radius of curvature of the skirt edge can be used in any embodiment of the present disclosure and in each one of the appended claims. When the skirt edge has an extension, unless otherwise indicated, any distance between the skirt edge and another entity is intended to mean a maximum distance from the skirt edge to that entity throughout the present application.

Purely by way of example, embodiments of the earpiece may be such that the positioning skirt portion is adapted to assume the use position at least partially within the concha cavity whereby:

at least a portion of the outer skirt surface abuts at least a portion of the concha ceiling, the skirt edge is located closer to the concha floor than each one of the outer skirt surface, and the skirt edge is spaced from the concha floor.

Optionally, as seen in a plane defined by the central axis and a radial axis being perpendicular to the central axis, the positioning skirt portion comprises a segment, extending between two distinct positions along the radial axis, being such that, when the peripheral skirt is in the non-influenced condition, each one of the inner skirt surface and the outer skirt surface associated with the segment is located on the same side of the skirt edge, as seen along the central axis. Such an implementation will further enhance the possibilities to deflect a portion of the positioning skirt portion by means of bending towards the central axis.

Optionally, the outer skirt surface comprises an outer skirt surface distal point located farthest away from the skirt edge, as seen along the outer skirt surface. Moreover, the inner skirt surface comprises an inner skirt surface distal point located farthest away from the skirt edge, as seen along the inner skirt surface. The outer skirt surface distal point is separate from the inner skirt surface distal point. At least a portion of the positioning skirt portion is such that, when the peripheral skirt is in the non-influenced condition, each one of the outer skirt surface distal point and the inner skirt surface distal point are located on the same side of the skirt edge, as seen along the central axis.

As such, as viewed from the inner and outer skirt surface distal points towards the skirt edge, at least a portion of the positioning skirt portion is slanted towards the skirt edge which will enhance the possibility to bend the edge towards the central axis.

As intimated hereinabove, the skirt edge is located closer to the concha floor than the outer skirt surface when the positioning skirt portion assumes its use position. As such, the expression "on the same side" used above results in locations such that skirt edge is located between the relevant portions of the inner and outer surfaces and the concha floor when the earpiece is moved in a direction towards the concha floor.

Optionally, an outer surface distance, as measured along the central axis, from the outer skirt surface distal point to the skirt edge is greater than an inner surface distance, as measured along the central axis, from the inner skirt surface distal point.

Optionally, when the peripheral skirt is in the non-influenced condition, a longest distance, as measured along the central axis, from the inner skirt surface distal point to the skirt edge is in the range of 1-8 mm, preferably in the range of 2-6 mm.

Optionally, the positioning skirt portion comprises a neutral layer located halfway between the inner skirt surface and the outer skirt surface, as seen in a direction parallel to a normal to the outer skirt surface. The neutral layer of at least a portion of the positioning skirt portion is such that it, as seen in a plane defined by the central axis and a radial axis being perpendicular to the central axis and when the peripheral skirt is in the non-influenced condition, comprises a first neutral layer point and a second neutral layer point separated by a distance along the radial axis. A neutral layer line extending through each one of the first and second neutral layer points forms a line angle to the central axis. The line angle is within the range of 15-65°.

Again, the skirt edge is located closer to the concha floor than the outer skirt surface when the positioning skirt portion assumes its use position. As such, the neutral layer line will intersect the central axis at an intersection point such that, as seen along the central axis, the skirt edge is located between the intersection point and the concha floor when the earpiece is moved in a direction towards the concha floor.

A line angle within the mentioned range implies an appropriate contact between the at least a portion of the outer skirt surface and the at least a portion of the concha ceiling during use, as well as implying that the skirt edge can assume a suitable condition, for instance abutting the concha wall, when the positioning skirt portion assumes the use position. Moreover, a line angle within the mentioned range also implies that the at least a portion of the positioning skirt portion may be deflected towards the central axis, for instance by bending a portion of the of the positioning skirt portion towards the central axis. After insertion at least partially within the concha cavity, the previously deflected portion of the of the positioning skirt portion flexes back towards its non-influenced condition and a contact between the outer surface and at least a portion of the concha ceiling may thus be obtained in an appropriate manner.

The line angle within the above range preferably applies for at least 30% of the positioning skirt portion, as seen along the circumferential direction of the outer skirt surface. Furthermore, the portion of the skirt comprising a maximum contour point, which will be discussed hereinbelow, is preferably such that the line angle is within the above range. Additionally, a portion of the positioning skirt portion comprising an elongate portion, which will be discussed hereinbelow, is preferably such that the line angle is within the above range.

Optionally, the distance between the first and second neutral layer points, as seen along the radial axis, is equal to or greater than 40%, more preferred equal to or greater than 80%, of the radial extension of the total neutral layer containing the first and second neutral layer points.

Optionally, the earpiece is such that the positioning skirt portion is adapted to assume a use position at least partially within the concha cavity whereby, for every portion along the skirt edge, an airgap is formed between the skirt edge and the concha floor. The airgap feature means that the earpiece does not comprise any component connecting the concha floor to the skirt edge when the positioning skirt portion assumes the use position.

Optionally, a skirt edge-free angular sector with its origin in the central axis is such that the angular sector is free from the skirt edge. The skirt edge-free angular sector has a skirt edge-free angular sector angle of at least 45°, preferably at least 90°. The skirt edge-free angular sector implies that the earpiece can be placed in an appropriate use position without necessarily abutting e.g. the crus of helix of an ear.

Optionally, the skirt edge-free angular sector angle is smaller than or equal to 320°, preferably smaller than or equal to 270°, more preferred smaller than or equal to 180°.

A skirt edge-free angular sector angle smaller than any one of the above angles implies than an appropriately large contact area can be established between the outer skirt surface and the concha ceiling.

Optionally, when the peripheral skirt is in the non-influenced condition, a projection of the peripheral skirt onto a plane, the normal of which coincides with the central axis, has an outer contour and the central axis is located within the outer contour. The central axis is positioned such that a minimum difference is obtained between a largest distance and a smallest distance from the central axis to the outer contour, as measured in the plane. The earpiece comprises a maximum contour point with a maximum distance in the plane from the central axis to the outer contour.

Optionally, an angular plane sector with its origin in the central axis is such that the angular plane sector is free from the peripheral skirt and/or that the distance from the central axis to each point of the outer contour in the angular plane sector is less than 85% of the maximum distance. The angular plane sector has an angular plane sector angle of at least 40°, preferably at least 90°. An angular plane sector angle smaller than any one of the above angles implies that the earpiece can be placed in an appropriate use position without necessarily abutting e.g. the crus of helix of an ear.

Optionally, a maximum contour point line extending from the central axis to the maximum contour point forms a smallest angle with a line defining the angular plane sector. The smallest angle is in the range of 0-15°, preferably within the range of 0-5°. A smallest angle within any one of the above ranges implies that the outer skirt surface can abut a portion of the concha ceiling which is located relatively high up the ear, for instance in the area of the antihelix without necessarily abutting e.g. the crus of helix of an ear.

Optionally, the earpiece comprises a proximal contour point with a proximal distance in the plane from the central axis to the outer contour, wherein a ratio between the maximum distance and the proximal distance is equal to or greater than 1.1, preferably equal to or greater than 1.5. A ratio within any one of the above ranges implies that the outer contour may be adapted to follow shape of ear portions delimiting a concha cavity.

Optionally, the outer contour is such that the distance from the central axis to the outer contour increases gradually, preferably continuously, from the proximal contour point to the maximum contour point.

Optionally, the outer contour further comprises an interim contour point wherein the distance from the central axis to the interim contour point is greater than the proximal distance but smaller than the maximum distance, wherein a largest angular segment with its origin in the central axis and which includes the maximum contour point, the proximal contour point and the interim contour point has an angle of at least 40°, preferably at least 120°, more preferred at least 180°.

Optionally, a projection of the skirt edge onto the plane, the normal of which coincides with the central axis, coincides with at least a portion of the outer contour.

Optionally, a smallest circle that circumscribes the outer contour has a diameter within the range of 15-31 mm, preferably within the range of 19-27 mm. A diameter within any one of the above ranges implies that the positioning skirt portion can be large enough to be able to contact various portions of an ear, thereby ensuring an appropriately connection between the positioning skirt portion and the ear.

Optionally, the positioning skirt portion comprises a distal portion adapted to be located farthest away from the concha floor, as seen along the central axis, when the positioning skirt portion assumes the use position. The positioning skirt portion extends at least partially from the distal portion to the skirt edge.

Optionally, at least a portion of the skirt edge is adapted to be deflected, relative to the distal portion, in a direction towards the central axis to thereby allow that the positioning skirt portion can be moved to the use position.

Optionally, each one of two portions of the skirt edge, being located on opposite sides of the central axis, is adapted to be deflected, relative to the distal portion, in a direction towards the central axis to thereby allow that the positioning skirt portion can be moved to the use position.

Optionally, a portion of the peripheral skirt is adapted to be elastically deformed such that the distance in the plane from the central axis to the outer contour of the portion can be elastically reduced by at least 5%. Preferably, the portion of the peripheral skirt that can be elastically deformed in accordance with the above forms part of the positioning skirt portion. An elastic deformation in accordance with the above implies that the insertion of the positioning skirt portion at least partially into the concha cavity can be carried out in a straightforward manner.

Optionally, the positioning skirt portion comprises a plurality of openings extending from the inner skirt surface to the outer skirt surface. The plurality of openings may contribute to the comfort for the user since the openings may reduce the area of continuous contact between the outer skirt surface and the concha ceiling.

Optionally, a material thickness of the positioning skirt portion is defined as the distance between the inner skirt surface and the outer skirt surface, as seen in a direction parallel to the normal to the outer skirt surface.

Optionally, when following the positioning skirt portion from the distal portion to the skirt edge, a minimum material thickness of the positioning skirt portion is less than 75% of a maximum material thickness of the positioning skirt portion. The minimum thickness less than the above value implies that the positioning skirt portion comprises a relatively weaker portion that can deform and thus act as a hinge when the positioning skirt portion is at least partially inserted into the concha cavity.

Optionally, a portion with the minimum material thickness is located at a minimum material thickness distance—as seen along a radial axis being perpendicular to the central axis—from the distal portion, the minimum material thickness distance being in the range of 0-80%, preferably in the range of 0-40%, more preferred in the range 0-25%, of the distance from the distal portion to the skirt edge, as seen along the radial axis. A minimum material thickness distance within the above range implies that the deformation of the positioning skirt portion occurs at a suitable location which simplifies the insertion of the positioning skirt portion at least partially into the concha cavity.

Optionally, the positioning skirt portion comprises an elongate portion being such that an elongate portion length, being the distance of the elongate portion along the outer skirt surface from the distal portion to the skirt edge, is greater than an average material thickness of the elongate portion, when following the elongate portion from the distal portion to the skirt edge. Preferably, the elongate portion length is at least 1.05 times, preferably the elongate portion length is at least 1.5 times, more preferred the elongate portion length is at least twice, the average material thickness of the elongate portion.

Optionally, the skirt comprises portions of a resilient polymer having a Shore A durometer within the range of 25-90. Preferably, the resilient polymer comprises silicone or a thermoplastic elastomer.

Optionally, the positioning skirt portion comprises a plurality of circumferentially separated positioning skirt portion tongues, each positioning skirt portion tongue extending with an increasing distance from the central axis to a positioning skirt portion tongue edge forming part of the skirt edge.

Optionally, the concha ceiling, which at least a portion of the outer skirt surface is adapted to abut when the positioning skirt portion assumes the use position, comprises a ceiling portion from at least one of the following portions of the ear: an antihelix, a tragus and an antitragus. Preferably, the concha ceiling comprises a ceiling portion from the antihelix.

Optionally, the earpiece is such that the positioning skirt portion is adapted to assume a use position at least partially within the concha cavity whereby,

- a first portion of the outer skirt surface abuts a ceiling portion of the antihelix, and
- a second portion of the outer skirt surface abuts a ceiling portion of the antitragus.

Optionally, the earpiece is such that the positioning skirt portion is adapted to assume the use position at least partially in the concha cavity, whereby a minimum distance between the skirt edge and the concha floor, as seen along the central axis of the earpiece, is at least 0.5 mm, preferably at least 1.0 mm, more preferred at least 1.5 mm. Such a minimum distance implies an appropriate degree of comfort for the user.

Optionally, the positioning skirt portion is adapted to assume the use position at least partially in the concha cavity such that at least a portion of the skirt edge abuts at least a portion of the concha side wall, thereby preventing the skirt edge from contacting the concha floor. As such, the contact between the skirt edge and the concha side wall can contribute to preventing the skirt edge from contacting the concha floor when the positioning skirt portion assumes the use position.

Optionally, the concha floor has a concha main floor plane with a concha main floor plane normal extending in a concha floor normal direction out from the ear, the concha side wall forming an angle of 30° or less to the concha floor normal direction.

Optionally, the concha side wall is such that the normal of two concha side wall portions, located on opposite sides of the central axis, are directed towards each other.

Optionally, the earpiece further comprises a housing, wherein the peripheral skirt at least partially circumscribes the housing.

Optionally, at least a portion of the skirt edge is adapted to be deflected, relative to the housing, in a direction towards the central axis to thereby allow that the positioning skirt portion can be moved to the use position.

Optionally, each one of two portions of the skirt edge, located on opposite sides of the central axis, is adapted to be deflected, relative to the housing, in a direction towards the central axis to thereby allow that the positioning skirt portion can be moved to the use position.

Optionally, the earpiece further comprises a movement-prevention member adapted to prevent the positioning skirt portion from moving relative to the concha floor to a position in which at least a portion of the skirt edge contacts the concha floor.

Optionally, the housing comprises a concha floor abutment portion forming at least part of the movement-prevention member. The earpiece is such that the housing is adapted to assume a use position at least partially within the concha cavity in which the concha floor abutment portion abuts the concha floor, thereby preventing the skirt edge from contacting the concha floor.

Optionally, the movement-prevention member comprises an outward abutment portion. The outward abutment portion is adapted to abut a portion of the ear being opposite to the concha ceiling when the earpiece assumes a use position.

Optionally, the outward abutment portion is adapted to abut an outer part of the antihelix of the ear when the earpiece assumes the use position.

Optionally, at least the outer skirt surface is pleated, preferably at least the positioning skirt portion is pleated, more preferred the peripheral skirt is pleated.

Optionally, a surface roughness of the outer skirt surface, as measured in a direction from the central axis to the skirt edge, is equal to or greater than 0.1 mm.

Optionally, the earpiece further comprises sound emitting means, preferably a loudspeaker.

Optionally, the earpiece further comprises attachment means for connection to a sidepiece of a pair of glasses.

BRIEF DESCRIPTION OF THE DRAWINGS

With reference to the appended drawings, below follows a more detailed description of embodiments of the disclosure cited as examples.

In the drawings.

DETAILED DESCRIPTION OF PREFERRED EMBODIMENTS

Preferred embodiments of the present disclosure will be discussed hereinbelow with reference to the appended drawings. Throughout the application, any range should be construed as a closed range. Put differently, any range used in the application should be construed as including the end points of the range.

Figure 1B:
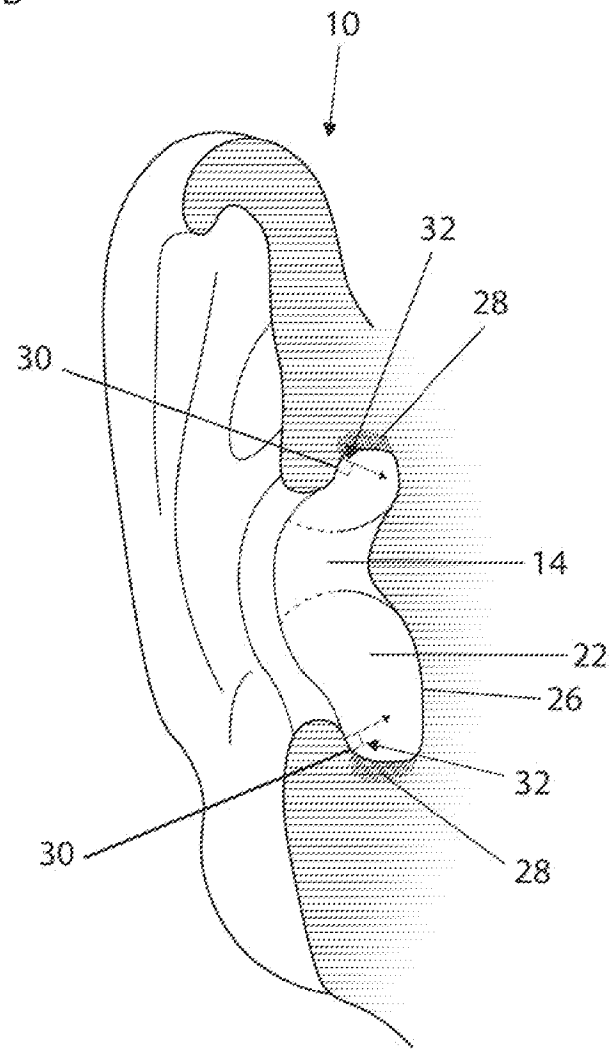
FIGS. 1A and 1B illustrate a human ear.
Figure 1A:
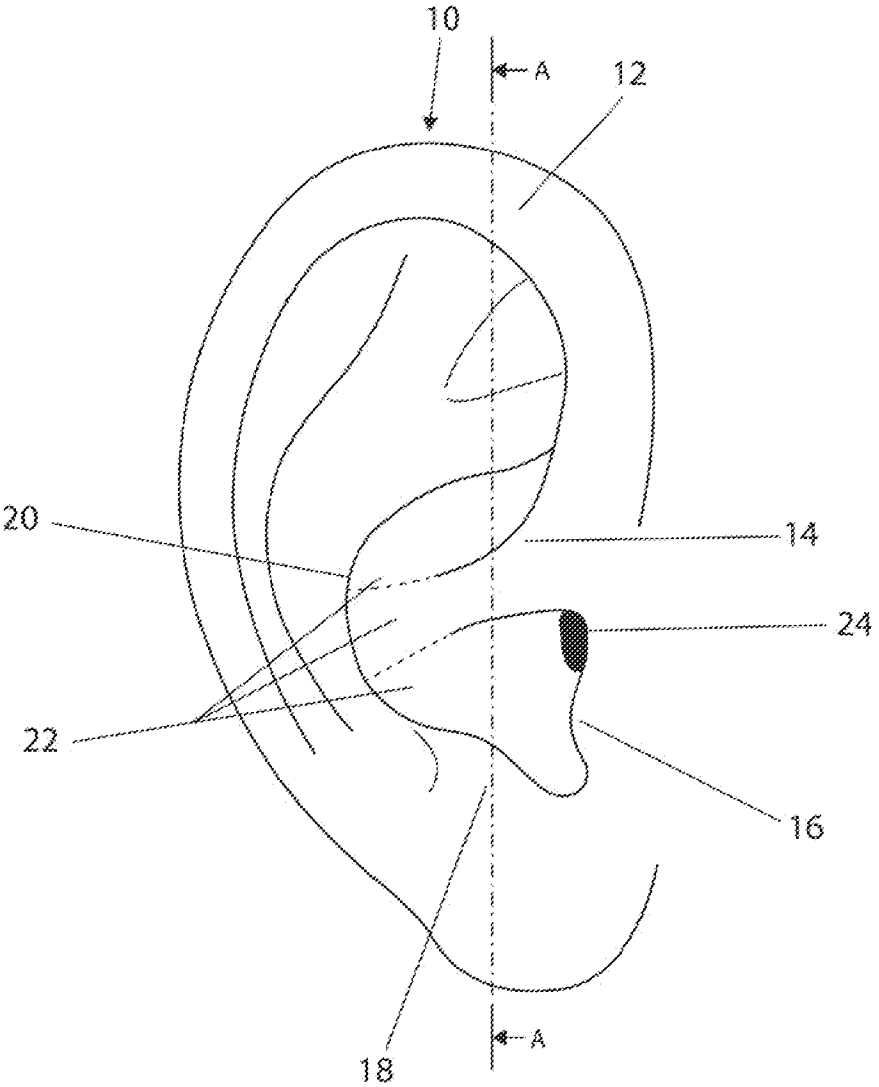

FIG. 1A illustrates the structure of an ear 10. As used herein, the term "ear" relates to a human ear. The ear 10 may also be referred to as pinna or auricle. The ear 10 comprises a helix 12 tracing the periphery of the ear upwards and inwards towards the skull wherein it transitions into the crus of helix 14.

Moreover, FIG. 1A illustrates that the ear 10 comprises a tragus 16, an antitragus 18 and an antihelix 20. Moreover, a concha cavity 22 is at least partially delimited by the tragus 16, an antitragus 18 and an antihelix 20. Moreover, FIG. 1A illustrates an ear canal 24.

FIG. 1B illustrates a cross-sectional view of the FIG. 1A ear 10. As may be gleaned from FIG. 1B, the concha cavity 22 is at least partially delimited by a concha floor 26, a concha side wall 28 and a concha ceiling 30. As will be discussed below, the concha ceiling 30 may be formed by one or more components of the ear, such as at least portions of the tragus 16, antitragus 18 and antihelix 20. The concha side wall 28 connects the concha floor 26 to the concha ceiling 30. Moreover, as indicated in FIG. 1B, the surface of the concha ceiling 30 has a normal 32, at least a component of which is directed towards the concha floor 26.

Figure 2B:
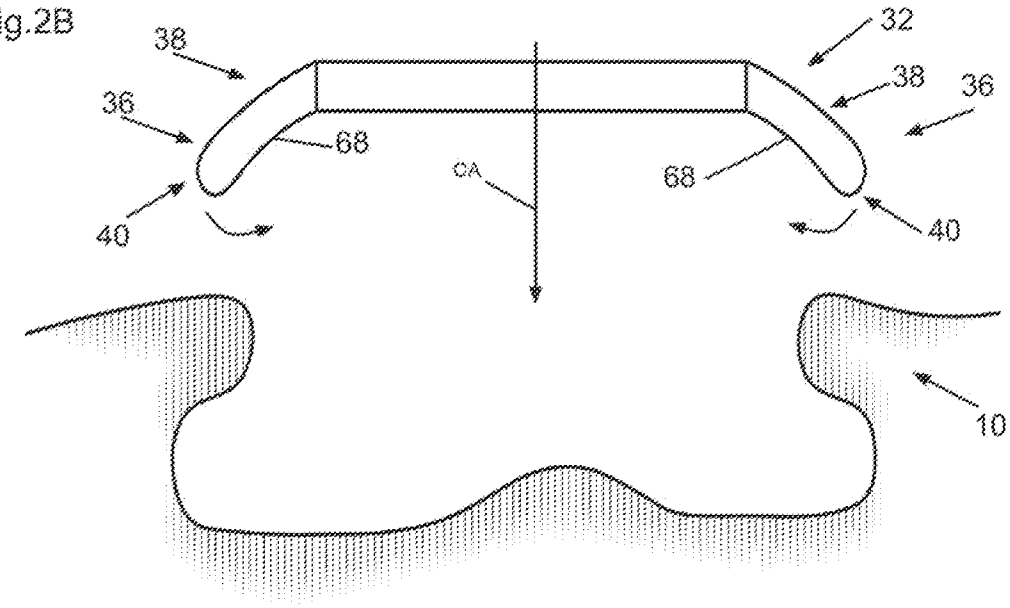
FIGS. 2A-2C illustrate an embodiment of an earpiece.
Figure 2C:
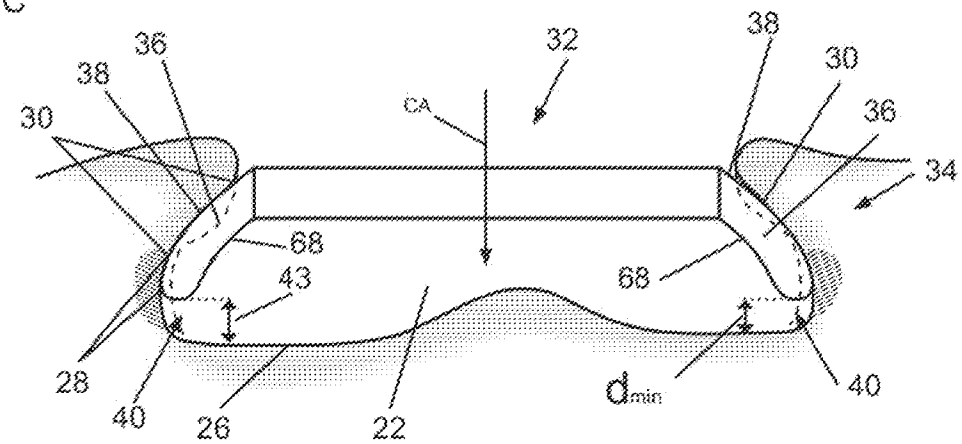
Figure 2A:
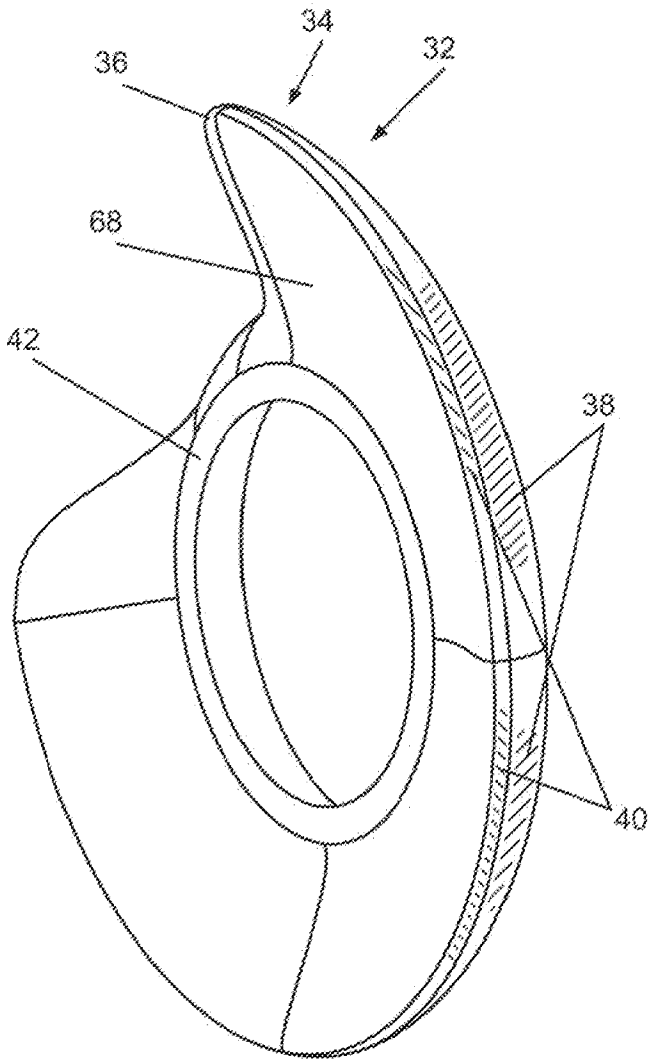

FIG. 2A to FIG. 2C illustrate an embodiment of an earpiece 32 for an ear in accordance with the present disclosure. The earpiece 32 comprises a peripheral skirt 34 comprising a positioning skirt portion 36 which in turn comprises an outer skirt surface 38 and an inner skirt surface 68, wherein a transition from the outer skirt surface 38 to the inner skirt surface 68 occurs at a skirt edge 40. Preferably, and as illustrated in e.g. FIG. 2A, each one of the inner and outer skirt surfaces 68, 38 terminates at the skirt edge 40.

In the embodiment illustrated in FIG. 2A, the positioning skirt portion 36 constitutes the complete peripheral skirt 34. However, in other embodiments of the earpiece 32, the peripheral skirt 34 may comprise skirt portions (not shown in FIG. 2A) in addition to the positioning skirt portion 36. Furthermore, in the FIG. 2A embodiment, the earpiece comprises a frame 42 adapted to receive a housing (not shown) for the earpiece 32.

However, it is also envisaged that embodiments of the earpiece may be such that a housing is directly attached to the peripheral skirt 34 or that the peripheral skirt 34 and the housing form a unitary component (not shown in FIG. 2A to FIG. 2C).

FIG. 2B illustrates the earpiece 32 in a condition before portions of the earpiece 32 have been inserted into an ear 10. Moreover, in the condition illustrated in FIG. 2B, no external loads are imparted the said peripheral skirt 34. As such, FIG. 2B illustrates the peripheral skirt 34 in a non-influenced condition.

Furthermore, as may be gleaned from FIG. 2B, the skirt edge 40 extends at least partially circumferentially around a central axis CA of the earpiece 32. Moreover, FIG. 2B illustrates that the earpiece 32 is adapted to be moved to a use position, at least partially within the concha cavity 22, in a direction parallel to the central axis CA, during insertion of the earpiece 32 into the ear 10.

FIG. 2B also illustrates that, when the peripheral skirt 34 is in a non-influenced condition, at least a portion of the inner skirt surface 68 faces the central axis CA. As such, at least a portion of the positioning skirt portion 36 is slanted. In the FIG. 2B example, both sides of the positioning skirt portion 36 illustrated therein are slanted. Thus, though purely by way of example, at least a portion of the skirt edge 40 may be adapted to be deflected in a direction towards the central axis CA to thereby allow that the positioning skirt portion 36 can be moved to the use position. Such possible deflections are indicated by the arrows at the bottommost portion of FIG. 2B.

Furthermore, with reference to FIG. 2C, the earpiece 32 according to the present disclosure is such that the positioning skirt portion 36 is adapted to assume the use position at least partially within the concha cavity 22 whereby:

- at least a portion of the outer skirt surface 38 abuts at least a portion of the concha ceiling 30,
- the skirt edge 40 is located closer to the concha floor 26 than the outer skirt surface 38, and
- the skirt edge 40 is spaced from the concha floor 26.

The condition that the skirt edge 40 is spaced from the concha floor 26 may be determined in one or more of ways. Purely by way of example, an earpiece in accordance with the present disclosure may be placed in a use position least partially within the concha cavity 22 of a user. The user may thereafter present information as to whether or not he or she experiences a contact between the skirt edge 40 and the concha floor 26.

As another example, a substance, such as point, may be applied to the skirt edge 40 prior to inserting the positioning skirt portion 36 at least partially within the concha cavity 22. The earpiece 32 may thereafter be removed from the ear 10 and it may thereafter be possible to e.g. visually assess whether or not the skirt edge 40 has been in contact with the concha floor 26.

As such, with reference to FIG. 2C, the earpiece 32 is prevented from moving away from the concha floor 26, i.e. upwards in FIG. 2C, by virtue of the contact between at least a portion of the outer skirt surface 38 and at least a portion of the concha ceiling 30. Furthermore, in the FIGS. 2A to 2C embodiment, the earpiece 32 is prevented from moving further towards the concha floor 26, i.e. downwards in FIG. 2C, by virtue of contact forces between at least portions of the skirt edge 40 and portions of the concha side wall 28. However, as will be presented hereinbelow, the earpiece 32 may be prevented from moving further towards the concha floor 26 using means instead of or in addition to the skirt edge 40.

Furthermore, as indicated in FIG. 2C, the skirt edge 40 may be a free skirt edge such that no additional component of the earpiece 32 is located between the skirt edge and the ear 10, for instance the concha floor 26, when the earpiece 32 is in the use position. The earpiece 32 may be such that the positioning skirt portion 36 is adapted to assume a use position at least partially within the concha cavity 22 whereby, for every portion along the skirt edge 40, an airgap 43 is formed between the skirt edge 40 and the concha floor 26.

The FIG. 2C embodiment of the earpiece 32 may be such that the positioning skirt portion 36 is adapted to assume the use position at least partially in the concha cavity 22, whereby a minimum distance $d_{min}$ between the skirt edge 40 and the concha floor 22, as seen along a central axis CA of the earpiece 32, is at least 0.5 mm, preferably at least 1.0 mm, more preferred at least 1.5 mm. Purely by way of example, the minimum distance may be determined using the above-mentioned procedure involving the use of a substance, such as paint or ink.

Figure 3:
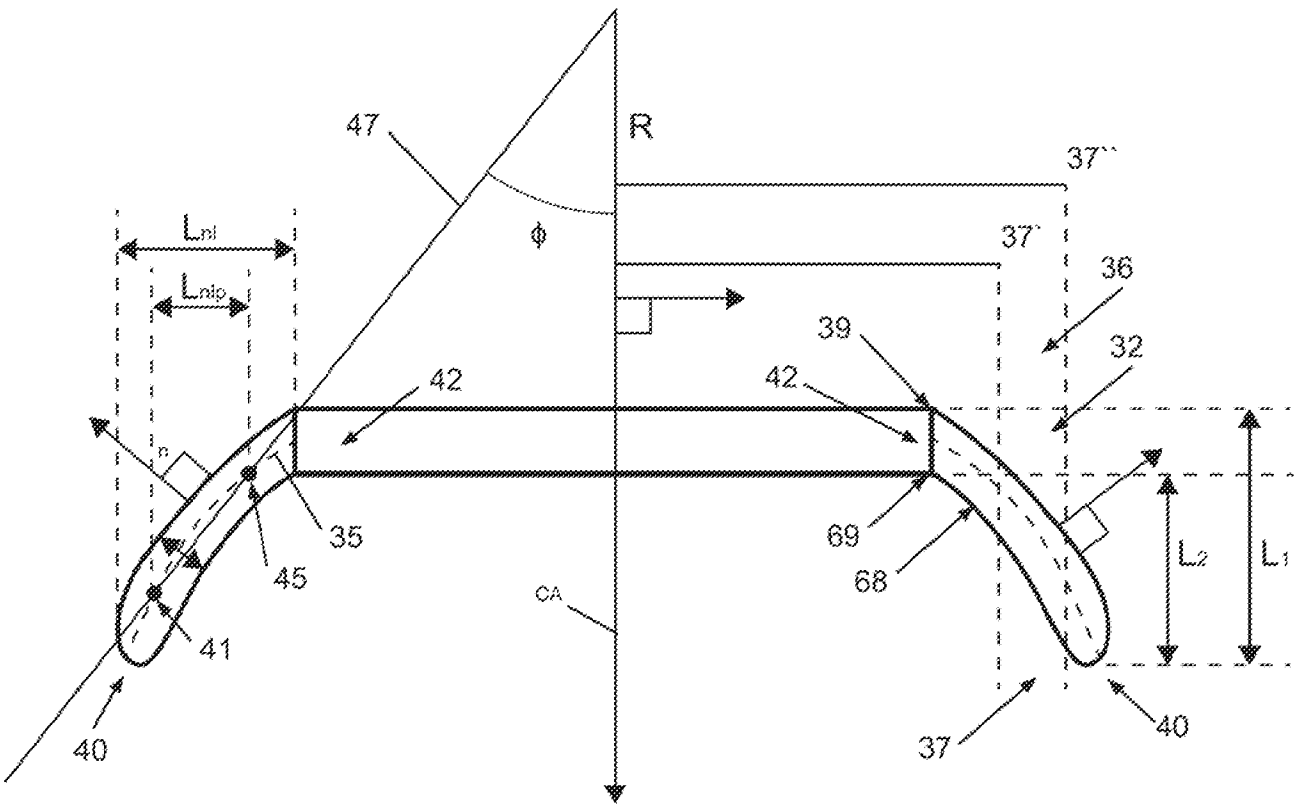
FIG. 3 illustrates a cross-sectional side view of an embodiment of an earpiece.

FIG. 3 illustrates a cross-sectional side view of an embodiment of an earpiece 32 when the peripheral skirt 34 is in the above-mentioned non-influenced condition. In particular, FIG. 3 illustrates the positioning skirt portion 36 of the earpiece 32. FIG. 3 illustrates a radial axis R being perpendicular to the central axis CA. Moreover, the central axis CA and the radial axis R define a plane, which is the plane of FIG. 3.

In this plane, the positioning skirt portion 36 comprises a segment 37, extending between two distinct positions 37', 37" along the radial axis R. Moreover, as may be realized from FIG. 3, the segment 37 is such that, when the peripheral skirt 34 is in the non-influenced condition, each one of the inner skirt surface 68 and the outer skirt surface 38 associated with the segment 37 is located on the same side of the skirt edge 40, as seen along the central axis CA. As such, the positioning skirt portion 36 comprises a "raised" portion with respect to the skirt edge 40.

Purely by way of example, the distance between the two distinct positions 37', 37", as seen along the radial axis R, may be equal to or greater than 40%, more preferred 80%, of the radial extension of the positioning skirt portion 36 which includes the two distinct positions 37', 37". In the FIG. 3 embodiment, the two distinct positions 37', 37" may actually be selected such that the distance between the two distinct positions 37', 37", as seen along the radial axis R, substantially equals the radial extension of the positioning skirt portion 36.

Moreover, FIG. 3 further illustrates that the outer skirt surface 38 may comprise an outer skirt surface distal point 39 located farthest away from the skirt edge 40, as seen along the outer skirt surface 38. Moreover, in FIG. 3, the inner skirt surface 68 comprises an inner skirt surface distal point 69 located farthest away from the skirt edge 40, as seen along the inner skirt surface 68. Purely by way of example, each one of the outer skirt surface distal point 39 and the inner skirt surface distal point 69 may be located at a frame 42 which has been discussed hereinabove. As another non-limiting example, each one of the outer skirt surface distal point 39 and the inner skirt surface distal point 69 may be located at an intersection between the positioning skirt portion 36 and a housing (not shown in FIG. 3) when the peripheral skirt 34 is connected to such a housing.

Moreover, again with reference to FIG. 3, the outer skirt surface distal point 39 may be separate from the inner skirt surface distal point 69. Further, in the FIG. 3 example, at least a portion of the positioning skirt portion 36 is such that, when the peripheral skirt 34 is in the non-influenced condition, each one of the outer skirt surface distal point 39 and the inner skirt surface distal point 69 are located on the same side of the skirt edge 40, as seen along the central axis CA.

Furthermore, FIG. 3 illustrates an embodiment of the earpiece 32 in which an outer surface distance $L_1$, as measured along the central axis CA, from the outer skirt surface distal point 39 to the skirt edge 40 is greater than an inner surface distance $L_2$, as measured along the central axis CA, from the inner skirt surface distal point 69.

Focusing on the left hand side of the FIG. 3 embodiment, in the embodiment illustrated in FIG. 3, the positioning skirt portion 36 may comprise a neutral layer 35 located halfway between the inner skirt surface 68 and the outer skirt surface 38, as seen in a direction parallel to a normal n to the outer skirt surface 38. Put differently, the neutral layer may be regarded as being located at half the thickness of the positioning skirt portion 36.

Further, as indicated in FIG. 3, the neutral layer 35 of at least a portion of the positioning skirt portion 36 is such that it, as seen in a plane defined by the central axis CA and the radial axis R and when the peripheral skirt 34 is in the previously discussed non-influenced condition, comprises a first neutral layer point 41 and a second layer point 45 separated by a distance $L_{nlp}$ along the radial axis R.

Moreover, as may be gleaned from FIG. 3, a neutral layer line 47 extending through each one of the first and second neutral layer points 41, 45 forms a line angle $\phi$ to the central axis CA. By way of example, the line angle $\phi$ may be within the range of 15-65°.

Thus, at least a portion of the neutral layer 35 is such that a neutral layer line 47 extending therethrough may form a line angle $\phi$ within the above-mentioned range. Purely by way of example, such a portion may be relatively large. As a non-limiting example, the portion may be such that the distance $L_{nlp}$ between the first and second neutral layer points 43, 45, as seen along the radial axis R, is equal to or greater than 40%, more preferred 80%, of the radial extension $L_{nl}$ of the total neutral layer containing the first and second neutral layer points 43, 45.

Figure 4:
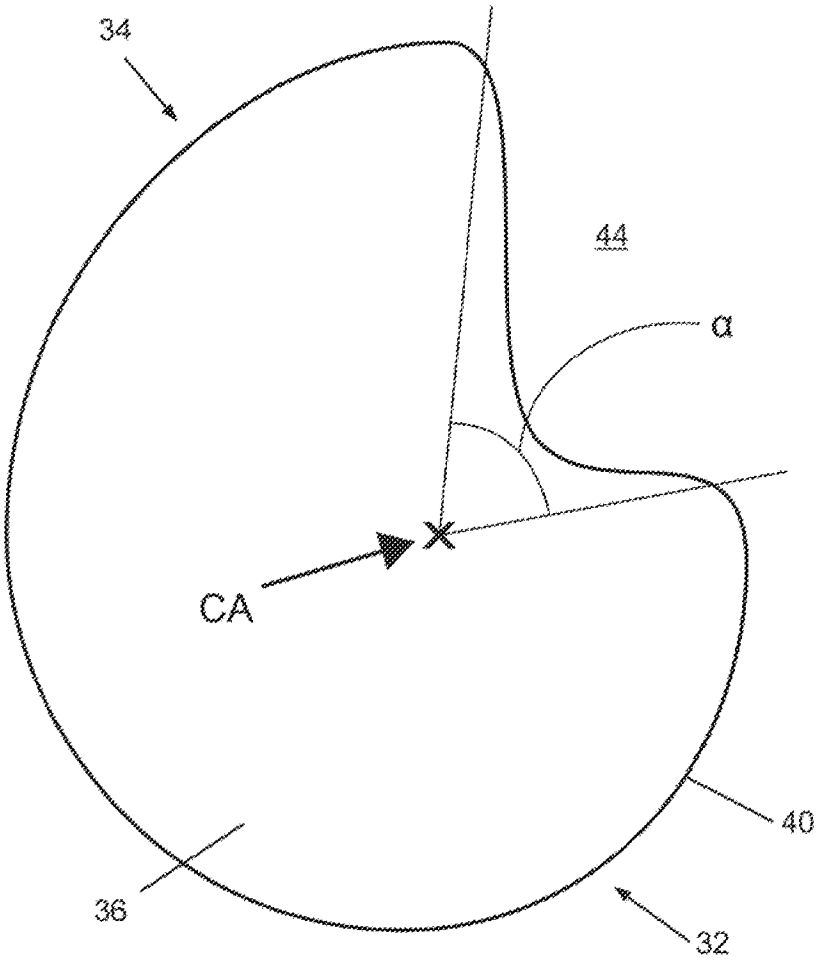
FIG. 4 illustrates another embodiment of the earpiece.

FIG. 4 illustrates an embodiment of the earpiece 32 in which a skirt edge-free angular sector 44 with its origin in the central axis CA is such that the angular sector 44 is free from the skirt edge 40. The skirt edge-free angular sector 44 has a skirt edge-free angular sector angle a of at least 45°, preferably at least 90°. The skirt edge-free angular sector 44 implies that the earpiece can be placed in an appropriate use position without necessarily abutting e.g. the crus of helix (see reference numeral 14 in FIG. 1A) of an ear 10.

Furthermore, though purely by way of example, the skirt edge-free angular sector angle a may be smaller than or equal to 320°, preferably smaller than or equal to 270°, more preferred smaller than or equal to 180°.

The skirt edge-free angular sector 44 can be regarded as a cut-out in the peripheral skirt 34 in the FIG. 4 embodiment. However, it is also possible to obtain embodiments of the earpiece 32 with the skirt edge-free angular sector 44 without using a cut-out. To this end, reference is made to the embodiment illustrated in FIG. 5.

Figure 5:
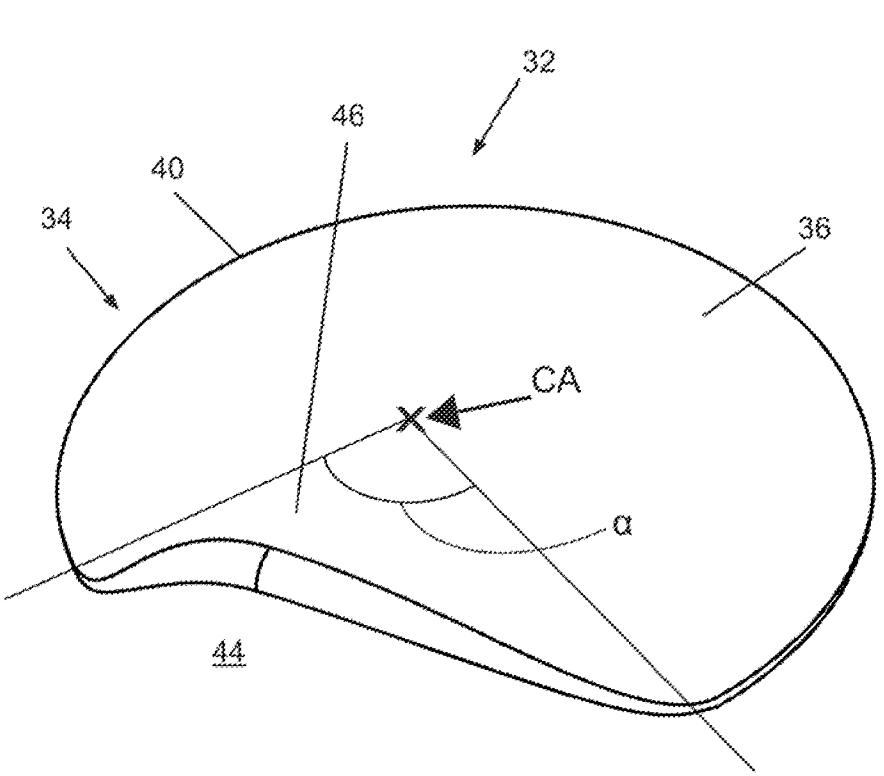
FIG. 5 illustrates a further embodiment of the earpiece.

The FIG. 5 embodiment of the earpiece 32 comprises a peripheral skirt 34, one portion of which being the positioning skirt portion 36 and an additional skirt portion 46 being shaped such that it is not adapted to assume a use position at least partially within the concha cavity 22 when the earpiece 32 is in a use position. As such, the additional skirt portion 46 does not comprise an outer skirt surface, as a consequence of which the additional skirt portion 46 does not terminate in a skirt edge within the meaning of the present disclosure. Thus the skirt edge-free angular sector 44 with the skirt edge-free angular sector angle a is obtained in the FIG. 5 embodiment by virtue of the upwardly bent shape of the additional skirt portion 46.

Figure 6:
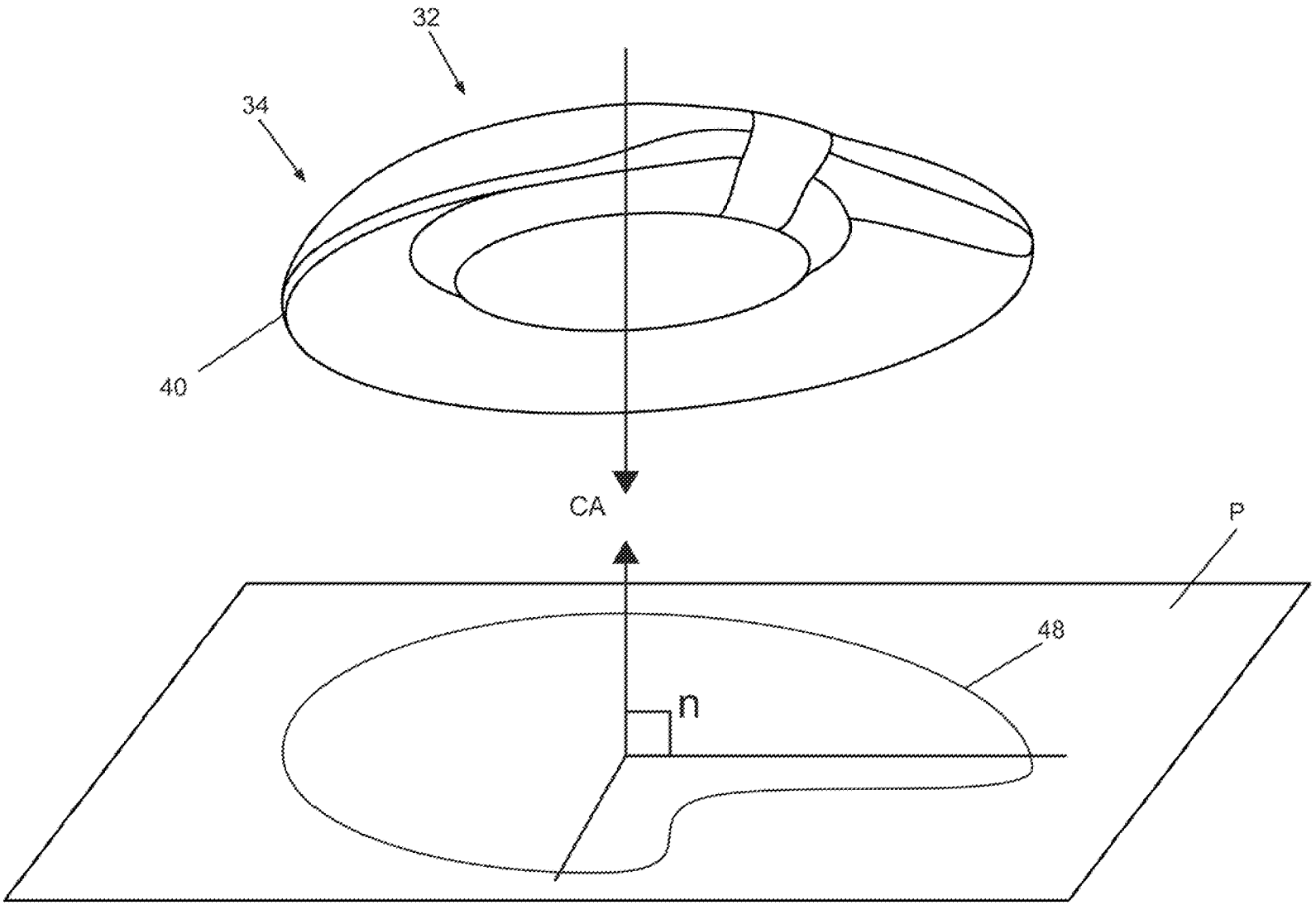
FIG. 6 illustrates an outer contour of a peripheral skirt of an earpiece.

FIG. 6 illustrates that a projection of the peripheral skirt 34, when the peripheral skirt 34 is in the non-influenced condition, onto a plane P, the normal n of which coincides with the central axis CA, has an outer contour 48 and the central axis CA is located within the outer contour. The central axis CA is positioned such that a minimum difference is obtained between a largest distance and a smallest distance from the central axis CA to the outer contour 48, as measured in the plane P.

Figure 7:
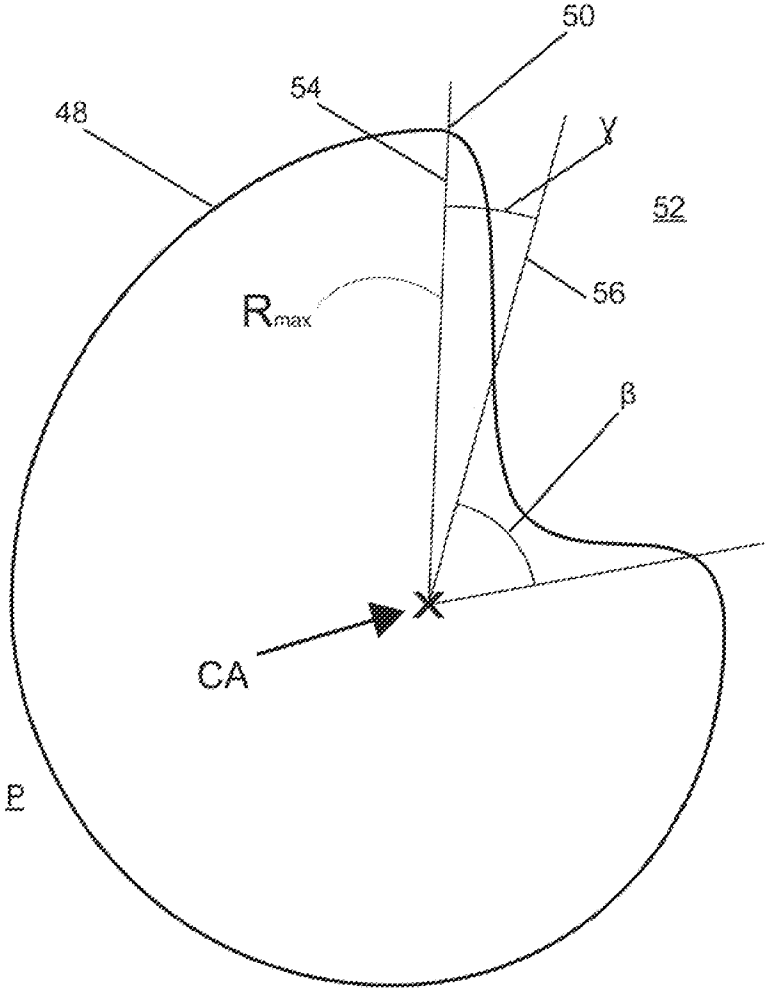
FIG. 7 illustrates an outer contour of a peripheral skirt of an embodiment of the earpiece.

FIG. 7 illustrates the outer contour 48 of a peripheral skirt 34 of an earpiece 32 in accordance with the present disclosure. As may be gleaned from FIG. 7, the FIG. 7 earpiece 32 comprises a maximum contour point 50 with a maximum distance $R_{max}$ in the plane P from the central axis CA to the outer contour 48.

Furthermore, the FIG. 7 embodiment of the earpiece 32 is such that an angular plane sector 52 with its origin in the central axis CA is such that the angular plane sector 52 is free from the peripheral skirt 34 and/or that the distance from the central axis CA to each point of the outer contour 48 in the angular plane sector 52 is less than 85% of the maximum distance $R_{max}$. Purely by way of example, the angular plane sector 52 has an angular plane sector angle β of at least 40°, preferably at least 90°.

With reference to FIG. 7, though purely by way of example, a maximum contour point line 54 extending from the central axis CA to the maximum contour point 50 forms a smallest angle γ with a line 56 defining the angular plane sector 52. The smallest angle γ is in the range of 0-15°, preferably within the range of 0-5°.

Figure 8:
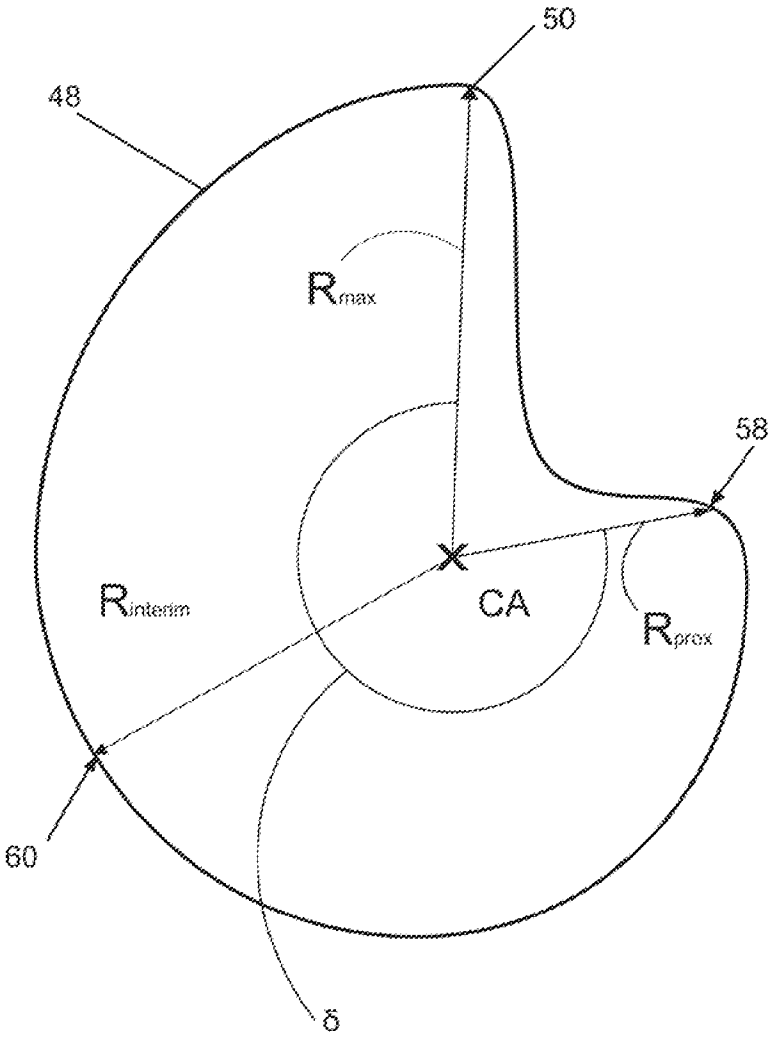
FIG. 8 illustrates an outer contour of a peripheral skirt of another embodiment of the earpiece.

FIG. 8 illustrates that the earpiece 32 may comprise a proximal contour point 58 with a proximal distance $R_{prox}$ in the plane P from the central axis CA to the outer contour 48. A ratio between the maximum distance $R_{max}$ and the proximal distance $R_{prox}$ may be equal to or greater than 1.1, preferably equal to or greater than 1.5. Moreover, as indicated in FIG. 8, the outer contour 48 may be such that the distance from the central axis CA to the outer contour 48 increases gradually, preferably continuously, from the proximal contour point 58 to the maximum contour point 50. As such, the outer contour 48 may follow a spiral shape from the proximal contour point 58 to the maximum contour point 50.

FIG. 8 further illustrates that the outer contour 48 further comprises an interim contour point 60 wherein the distance $R_{interim}$ from the central axis CA to the interim contour point 60 is greater than the proximal distance $R_{prox}$ but smaller than the maximum distance $R_{prox}$. Moreover, FIG. 8 illustrates that a largest angular segment with its origin in the central axis CA and which includes the maximum contour point 50, the proximal contour point 58 and the interim contour point 60 has an angle δ of at least 40°, preferably at least 120°, more preferred at least 180°.

In the example illustrated in FIG. 6, the projection of the skirt edge 40 onto the plane P, the normal of which coincides with the central axis CA, coincides with at least a portion of the outer contour 48. Put differently, in the FIG. 6 embodiment, the skirt edge 40 constitutes the outermost portion of at least portions of the peripheral skirt 34. However, it is also envisaged that embodiments of the earpiece 32 may comprise a peripheral skirt 34, portions of which being located at a larger distance from the central axis CA than a corresponding portion of the skirt edge 40.

Figure 9:
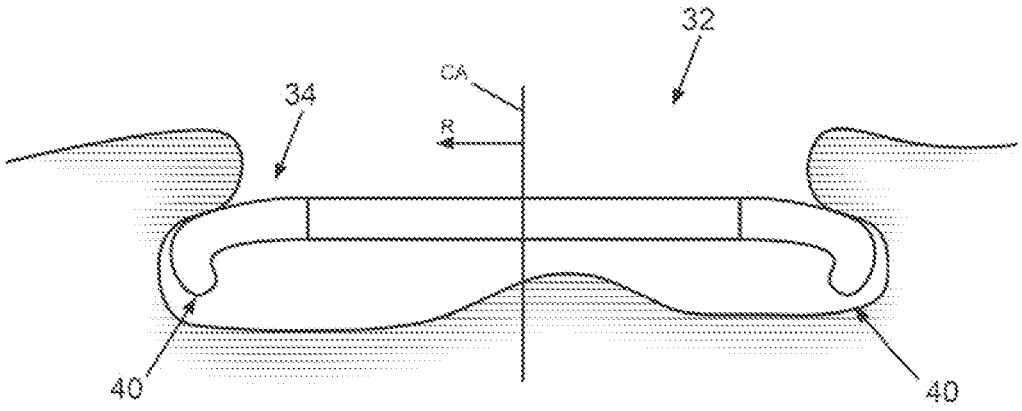
FIG. 9 illustrates a side view of a further embodiment of the earpiece.

An example of such an embodiment is illustrated in FIG. 9. In the FIG. 9 earpiece 32, the peripheral skirt 34 is such that a maximum radial distance from the central axis to CA the outermost portion of the skirt 34 is larger than the radial distance from the central axis CA to the corresponding portion of the edge 40. As such, a projection of the peripheral skirt 34 illustrated in FIG. 9 will not necessarily comprise any portion of the skirt edge 40.

Figure 10:
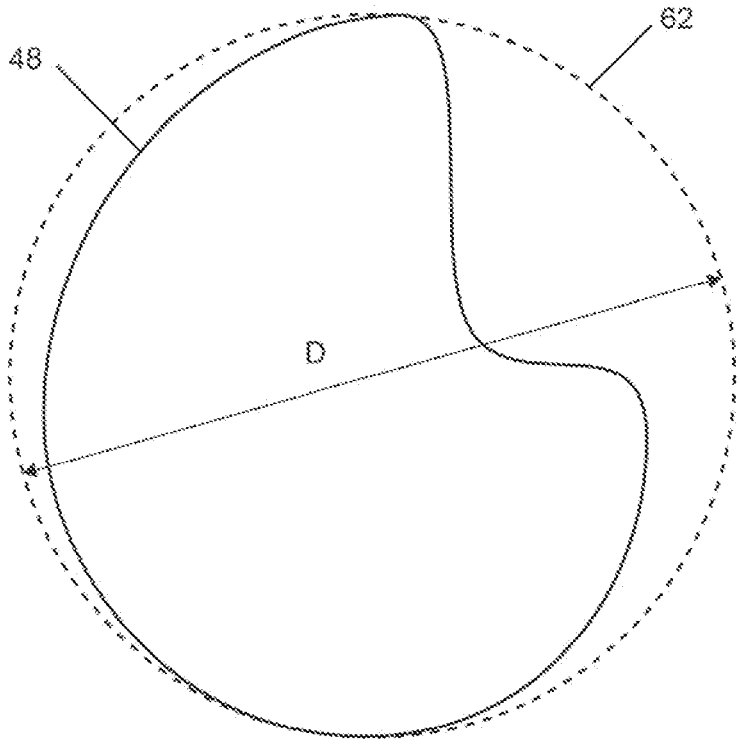
FIG. 10 illustrates an outer contour of a peripheral skirt of yet another embodiment of the earpiece.

FIG. 10 illustrates a smallest circle 62 that circumscribes the outer contour 48 of a peripheral skirt 34. Purely by way of example, the diameter D of the smallest circle 62 may be within the range of 15-31 mm, preferably within the range of 19-27 mm, for embodiments of the earpiece 32.

Moreover, irrespective of the shape of the outer contour, a portion of the peripheral skirt 34 may be such that it is adapted to be elastically deformed such that the distance in the plane from the central axis CA to the outer contour 48 of the portion can be elastically reduced by at least 5%. Preferably, the portion of the peripheral skirt 34 that can be elastically deformed in accordance with the above forms part of the positioning skirt portion 36.

Figure 11:
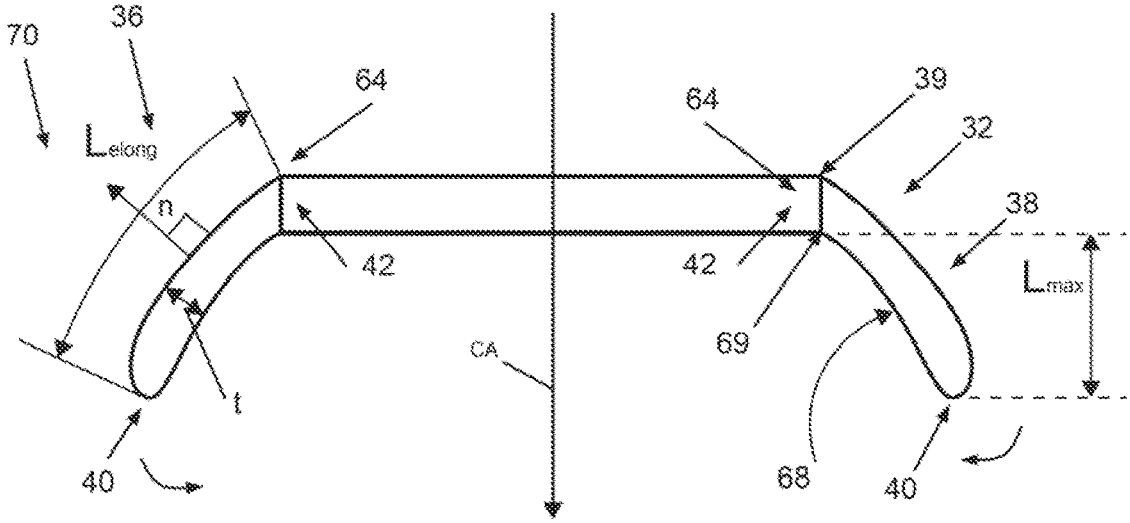
FIG. 11 illustrates a cross-sectional side view of an embodiment of an earpiece.

FIG. 11 illustrates a cross-sectional side view of an embodiment of an earpiece 32. In the FIG. 11 embodiment, the positioning skirt portion 36 comprises a distal portion 64 adapted to be located farthest away from the concha floor (not shown in FIG. 11), as seen along the central axis CA, when the positioning skirt portion 36 assumes the use position. The positioning skirt portion 36 extends at least partially from the distal portion 64 to the skirt edge 40. Purely by way of example, the distal portion 64 may be located at a frame 42 which has been discussed hereinabove. As another non-limiting example, the distal portion 64 may be located at the intersection between the positioning skirt portion 36 and a housing (not shown in FIG. 11) when the peripheral skirt 34 is connected to such a housing.

Furthermore, FIG. 11 illustrates a longest distance $L_{max}$, when the peripheral skirt is in the non-influenced condition, as measured along the central axis CA, from the inner skirt surface distal point 69 to the skirt edge 40. Purely by way of example, the longest distance $L_{max}$ may be in the range of 1-8 mm, preferably in the range of 2-6 mm.

Additionally, again with reference to FIG. 11, a material thickness t of the positioning skirt portion is defined as the distance between the inner skirt surface 68 and the outer skirt surface 38, as seen in a direction parallel to the normal n to the outer skirt surface. As such, the expression "material thickness" indicates that a value of the "material thickness" can only be determined for portions of the position skirt comprising skirt material between the inner skirt surface 68 and the outer skirt surface 38.

Moreover, FIG. 11 illustrates that the positioning skirt portion 36 may comprise an elongate portion 70 being such that an elongate portion length $L_{elong}$, being the distance of the elongate portion 70 along the outer skirt surface 38 from the distal portion 64 to the skirt edge 40, is greater than an average material thickness of the elongate portion 70, when following the elongate portion 70 from the distal portion 64 to the skirt edge 40. Preferably, the elongate portion length $L_{elong}$ is at least 1.05 times, preferably the elongate portion length $L_{elong}$ is at least 1.5 times, more preferred the elongate portion length $L_{elong}$ is at least twice, the average material thickness of the elongate portion 70.

Furthermore, as indicated by the arrows in FIG. 11, at least a portion of the skirt edge 40 may be adapted to be deflected, relative to the distal portion 64, in a direction towards the central axis CA to thereby allow that the positioning skirt portion 36 can be moved to the use position. In the example illustrated in FIG. 11, as indicated by the two arrows therein, each one of two portions of the skirt edge 40, being located on opposite sides of the central axis CA, is adapted to be deflected, relative to the distal portion 64, in a direction towards the central axis CA to thereby allow that the positioning skirt portion 36 can be moved to the use position.

Figure 16:
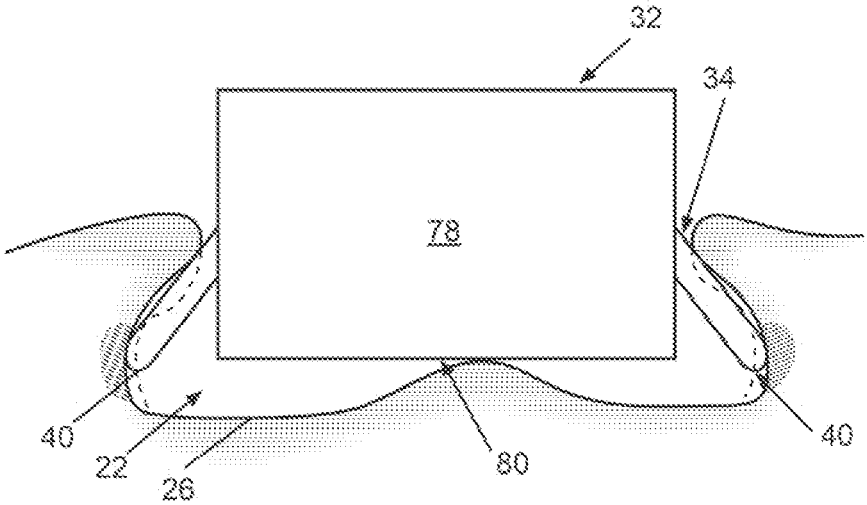
FIG. 16 illustrates a cross-sectional side view of another embodiment of an earpiece.

In embodiments of the earpiece 32 comprising a housing 78, see e.g. FIG. 16, the above discussed portions of the skirt edge 40 may instead and/or in addition be adapted to be deflected relative to the housing 78.

Figure 12A:
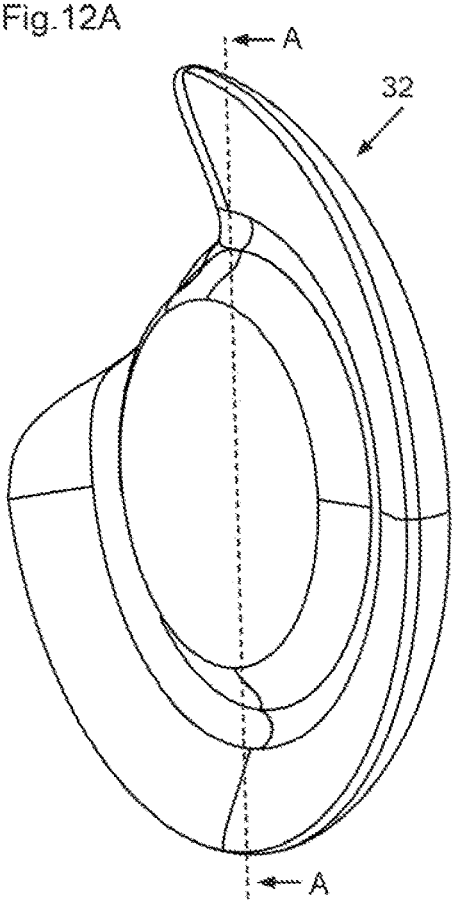
FIGS. 12A and 12B illustrate yet another embodiment of the earpiece.
Figure 12B:
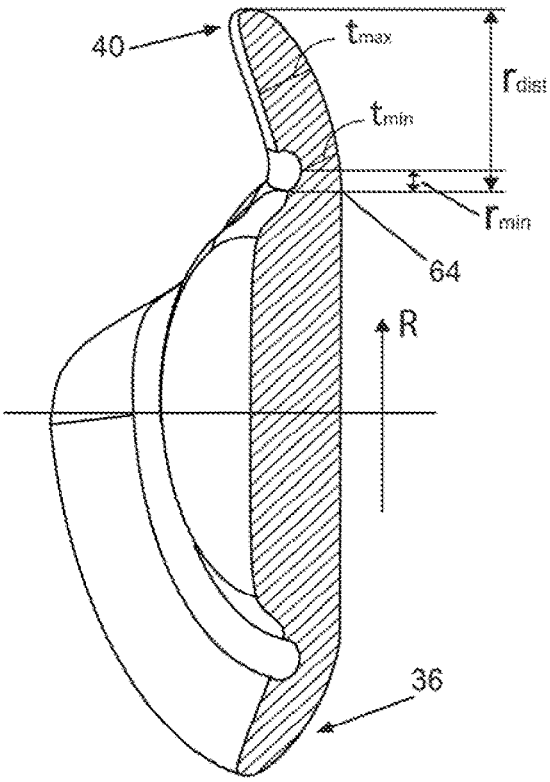

FIGS. 12A and 12B illustrate another embodiment of the earpiece 32. With reference to FIG. 12B, when following the positioning skirt portion 36 from the distal portion 64 to the skirt edge 40, a minimum material thickness $t_{min}$ of the positioning skirt portion 36 is less than 75% of a maximum material thickness $t_{max}$ of the positioning skirt portion 36.

Moreover, a portion with the minimum material thickness $t_{min}$ is, in the FIG. 12A and FIG. 12B embodiment, located at a minimum material thickness distance $r_{min}$—as seen along the radial axis R—from the distal portion 64. Purely by way of example, the minimum material thickness distance $r_{min}$ may be in the range of 0-80%, preferably in the range of 0-40%, more preferred in the range of 0-25%, of the distance $r_{dist}$ from the distal portion 64 to the skirt edge 40, as seen along the radial axis R.

The portion with the minimum material thickness $t_{min}$ may be regarded as a weakening of the positioning skirt portion 36 which allows the positioning skirt portion 36 to be deformed so as to be inserted at least partially within the concha cavity (not shown in FIG. 12A or FIG. 12B). Thus, the weakening may act as a hinge for the positioning skirt portion 36.

Figure 13:
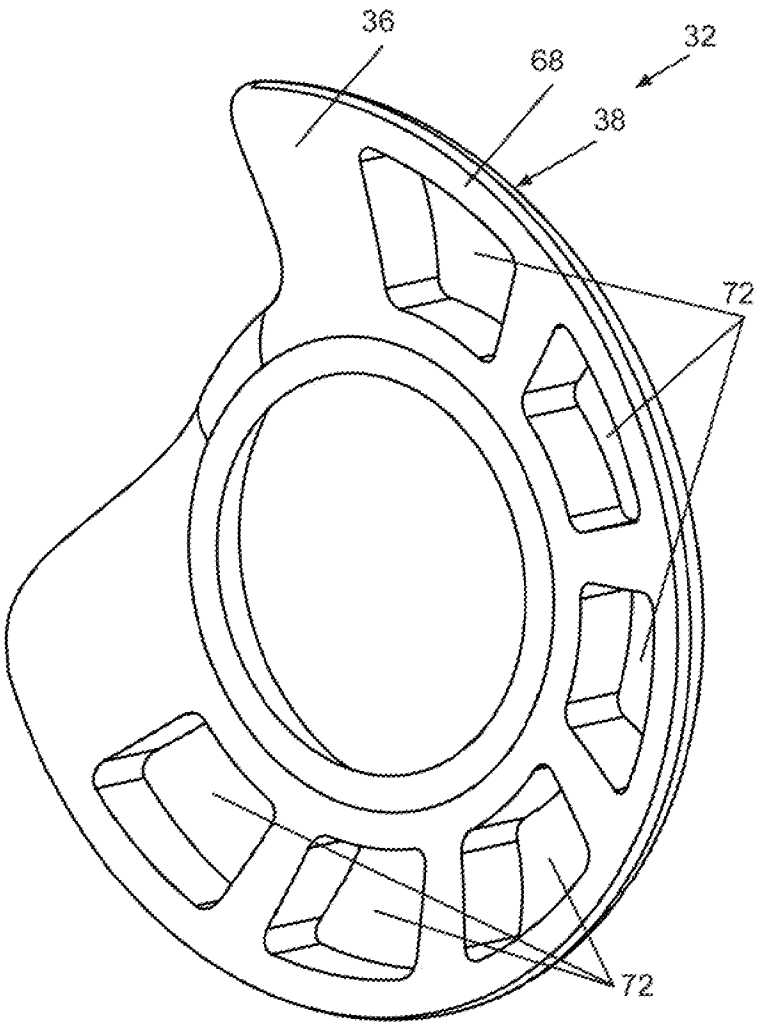
FIG. 13 illustrates a further embodiment of the earpiece.

FIG. 13 illustrates another embodiment of an earpiece 32 wherein the positioning skirt portion 36 comprises a plurality of openings 72 extending from the inner skirt surface 68 to the outer skirt surface 38.

Although the embodiments of the earpiece 32 which have been presented so far have comprised a circumferentially continuous positioning skirt portion with a circumferentially continuous skirt edge, it is also envisaged that embodiments of the earpiece 32 of the present disclosure may comprise a circumferentially discontinuous positioning skirt portion.

Figure 14:
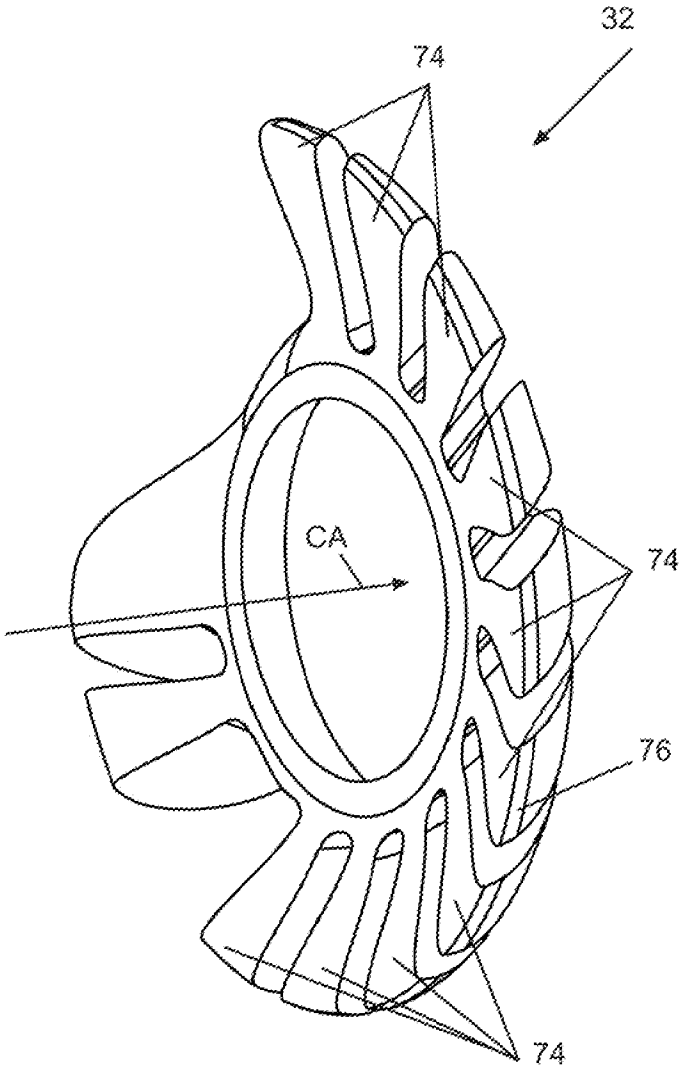
FIG. 14 illustrates another embodiment of the earpiece.

To this end, though purely by way of example, FIG. 14 illustrates an embodiment of the earpiece 32 wherein the positioning skirt portion 36 thereof comprises a plurality of circumferentially separated positioning skirt portion tongues 74. Each positioning skirt portion tongue 74 extends with an increasing distance from the central axis CA to a positioning skirt portion tongue edge 76 forming part of the skirt edge 40.

Purely by way of example, the skirt 34 comprises portions of a resilient polymer having a Shore A durometer within the range of 25-90. As a non-limiting example, the skirt 34 may be constituted by a resilient polymer having a Shore A durometer within the range of 25-90. Preferably, the resilient polymer comprises, alternatively, is constituted by, silicone or a thermoplastic elastomer. The material examples listed above may be used for any embodiment of the earpiece 32 of the present disclosure.

As a non-limiting example, and with reference to FIG. 1A and FIG. 1B, the concha ceiling, which at least a portion of said outer skirt surface 38 is adapted to abut when the positioning skirt portion 36 assumes the use position, comprises a ceiling portion from at least one of the following portions of the ear: an antihelix 20, a tragus 16 and an antitragus 18. Preferably, the concha ceiling comprises a ceiling portion from the antihelix 20.

Purely by way of example, and again with reference to FIG. 1A and FIG. 1B, the earpiece 32 may be such that the positioning skirt portion 36 is adapted to assume a use position at least partially within the concha cavity 22 whereby,

- a first portion of the outer skirt surface 36 abuts a ceiling portion of the antihelix 20, and
- a second portion of the outer skirt surface 36 abuts a ceiling portion of the antitragus 18.

Figure 15:
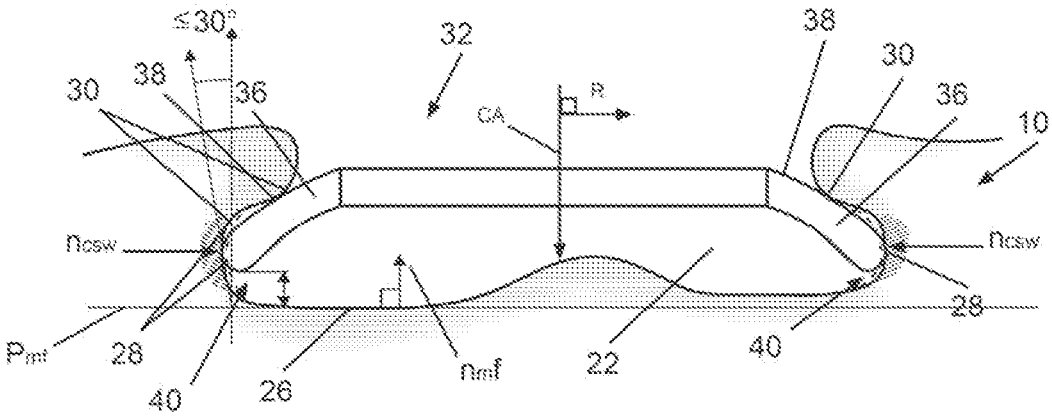
FIG. 15 illustrates a cross-sectional side view of a further embodiment of an earpiece.

FIG. 15 illustrates another embodiment of the earpiece 32. In the FIG. 15 embodiment, the positioning skirt portion 36 is adapted to assume the use position at least partially in the concha cavity 22 such that at least a portion of the skirt edge 40 abuts at least a portion of the concha side wall 28, thereby preventing the skirt edge 40 from contacting the concha floor 26. As such, the positioning skirt portion 36 is preferably such that the size and shape of the skirt edge 40 results in a contact between the skirt edge 40 and at least a portion of the concha side wall 28. Moreover, the positioning skirt portion 36 may be such that the skirt edge 40 is pressed outwards towards the concha side wall 28 when the skirt portion 36 assumes the use position. As a non-limiting example, the skirt edge 40 may pressed outwards if the positioning skirt portion 36 is associated with a line angle $\phi$ within the range of 15-65° as has been discussed hereinabove with reference to FIG. 3.

Furthermore, as indicated in FIG. 15, the concha floor 22 has a concha main floor plane $P_{mf}$ with a concha main floor plane normal $n_{mf}$ extending in a concha floor normal direction out from the ear 10. The concha side wall 28 forms an angle of 30° or less to the concha floor normal direction.

Instead of, or in addition to, defining the concha side wall 28 in relation to the concha floor normal direction, the concha side wall 28 may be presented such that the normal $n_{csw}$ of two concha side wall portions, located on opposite sides of the central axis CA, are directed towards each other. Such a scenario also is indicated in FIG. 15.

Instead of, or in addition to, preventing the skirt edge 40 from contacting the concha floor 26 by the skirt edge 40 abutting at least a portion of the concha side wall 28, embodiments of the earpiece 32 may further comprise a movement-prevention member adapted to prevent the positioning skirt portion 38 from moving relative to the concha floor 22 to a position in which at least a portion of the skirt edge 40 contacts the concha floor 22. Implementations of such a movement-prevention member will be discussed hereinbelow with reference to FIGS. 16-20.

In the FIG. 16 embodiment, the earpiece 32 further comprises a housing 78, wherein the peripheral skirt 34 at least partially circumscribes the housing 78. As has been discussed hereinabove, though purely by way of examples, the housing 78 may be connected to the peripheral skirt 34 via a frame (not shown in FIG. 16) or the housing 78 may be directly attached to the peripheral skirt 34, alternatively the peripheral skirt 34 and the housing 78 may form a unitary component.

Irrespective of how the housing 78 and the peripheral skirt 34 are connected to each other, the FIG. 16 housing 78 comprises a concha floor abutment portion 80. As such, in the FIG. 16 embodiment, the concha floor abutment portion 80 forms at least part of the movement-prevention member.

Moreover, as illustrated in FIG. 16, the earpiece 32 is such that the housing 78 is adapted to assume a use position at least partially within the concha cavity 22 in which the concha floor abutment portion 80 abuts the concha floor 26, thereby preventing the skirt edge 40 from contacting the concha floor 26.

Purely by way of example, the earpiece 32 may comprise a sensor (not shown) for detecting contact between housing 78 and concha floor 26. As a non-limiting example, such a sensor may be accommodated within the housing 78.

Figure 17:
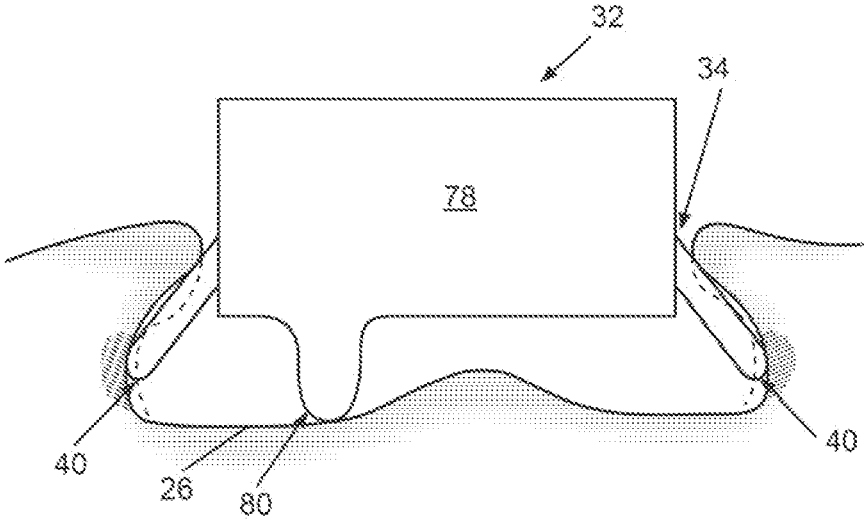
FIG. 17 illustrates a cross-sectional side view of yet another embodiment of an earpiece.

In the FIG. 16 embodiment, the portion of the housing 78 that is adapted to face the concha floor 26 is relatively flat. However, it is also envisaged that the concha floor abutment portion 80 may protrude from the remaining portion of the housing 78. An example of such an embodiment is illustrated in FIG. 17. As a non-limiting example, the concha floor abutment portion 80 may be adapted to abut a portion of the concha floor 26 at or around the ear canal (not shown in FIG. 17) of the ear 10. In such an embodiment, the concha floor abutment portion 80 may comprise means, such as an audio duct opening, for guiding sound from the at least a portion of the housing 78, for instance from a sound emitting component of the housing 78, to the ear canal.

Figure 18C:
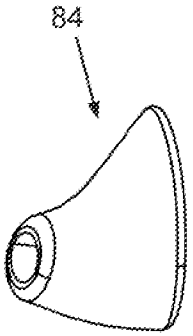
FIGS. 18A-18E illustrate still another embodiment of the earpiece.
Figure 18D:
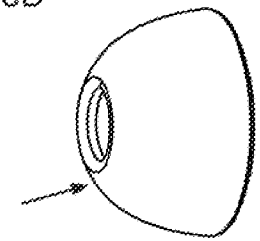
Figure 18E:
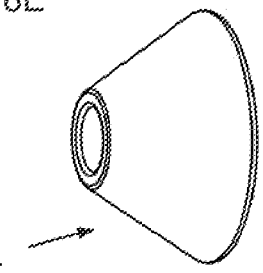
Figure 18B:
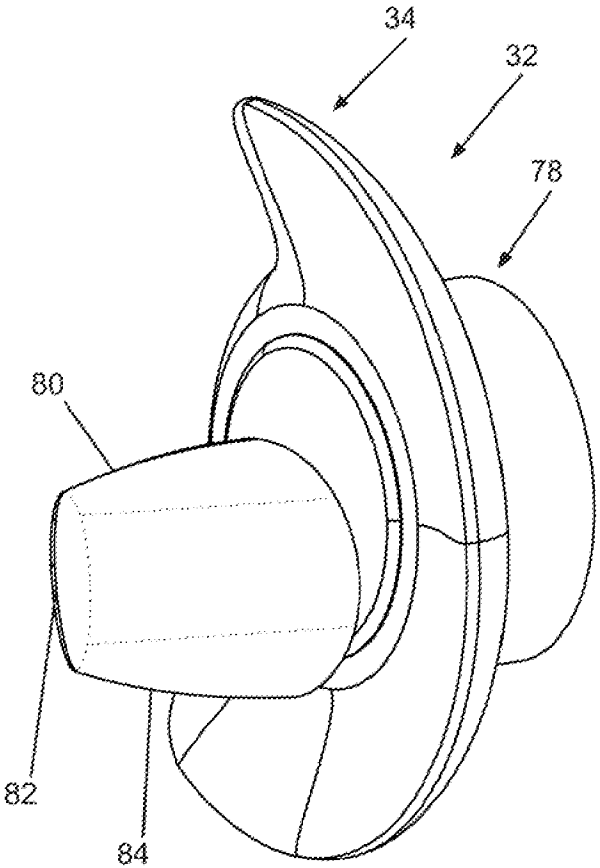
Figure 18A:
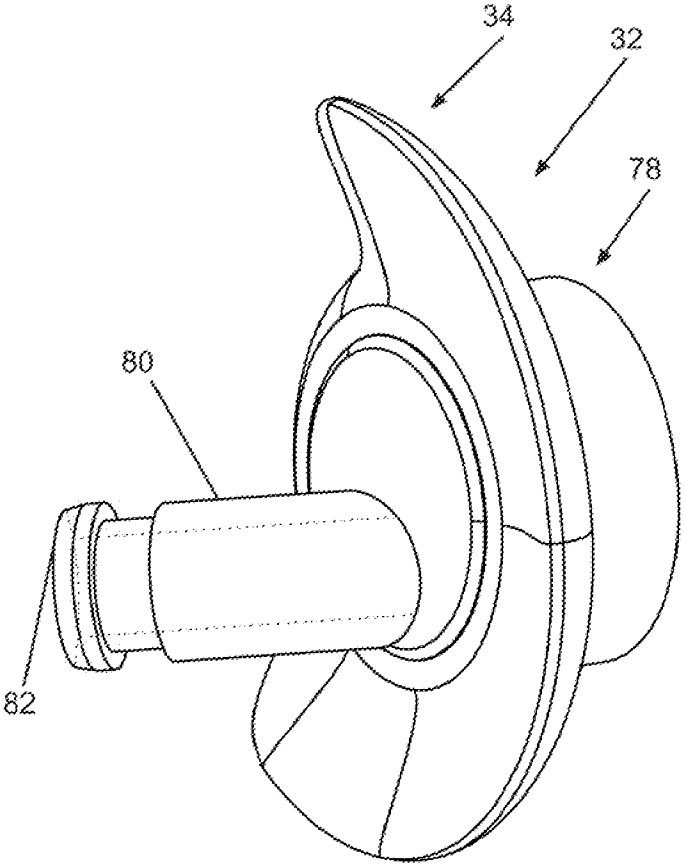

FIG. 18A illustrates an embodiment of the earpiece 32 in which the above-mentioned concha floor abutment portion 80 is implemented as a nozzle extending from the housing 78. The FIG. 18A nozzle 80 comprises an audio duct opening 82. Purely by way of example, the length of the nozzle 80 may be fixed. As another non-limiting example, the length of the nozzle 80 may be varied such that the length may be adapted to the user of the earpiece 32. By way of example only, the length may be varied manually or using an actuator (not shown) associated with the earpiece 32.

Additionally, the nozzle 80 may be adapted to be bent relative to another portion of the housing 78. To this end, the earpiece 32, for instance the nozzle 80 and/or another portion of the housing 78, may comprise a joint (not shown) allowing the nozzle 80 to be bent or deflected relative to another portion of the housing 78.

The possibility to adjust the length and/or the angle of the nozzle 80 relative to another portion of the housing 78 implies an increased flexibility for a user to adjust the earpiece 32 to the user's ear.

FIG. 18B illustrates the FIG. 18A embodiment of the earpiece 32 although an eartip 84 has been fitted onto the nozzle 80. It should be noted that the nozzle 80 may be furnished with an eartip irrespective of whether the nozzle 80 is fixed, adjustable in length and/or adjustable in angle as mentioned hereinabove. FIG. 18C to FIG. 18E illustrate implementations of eartips for fitting onto a nozzle 80, such as the FIG. 18A nozzle 80.

FIG. 18C illustrates an eartip 84 that is intended to be positioned in a sub tragic region immediately covered by the tragus. The FIG. 18C implementation may provide a comfortable fit without having to touch the ear canal or the opening of the ear canal. The FIG. 18C embodiment can provide some ambient sound into the ear and can be beneficial for mobile phone use.

Each one of FIG. 18D and FIG. 18E illustrates a frusto-conical eartip 84 that provides a close fit against the opening of the ear canal which may substantially eliminate ambient sound.

For the FIG. 16 to FIG. 18 embodiments, the housing 78 may further comprise sound emitting means, such as a loudspeaker.

Figure 20:
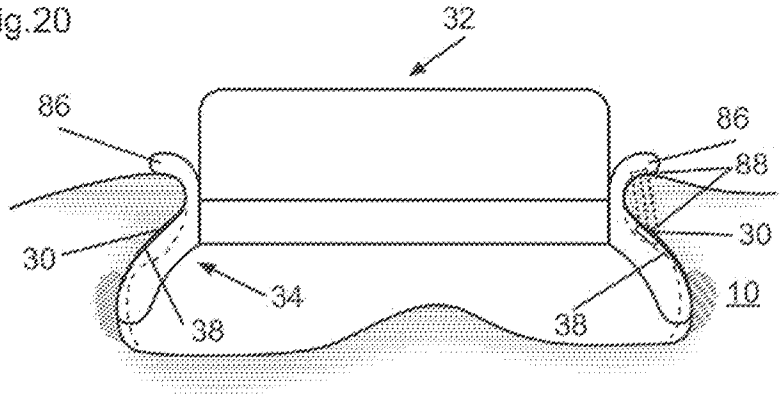
FIG. 20 illustrates a cross-sectional side view of an additional embodiment of the earpiece.
Figure 19:
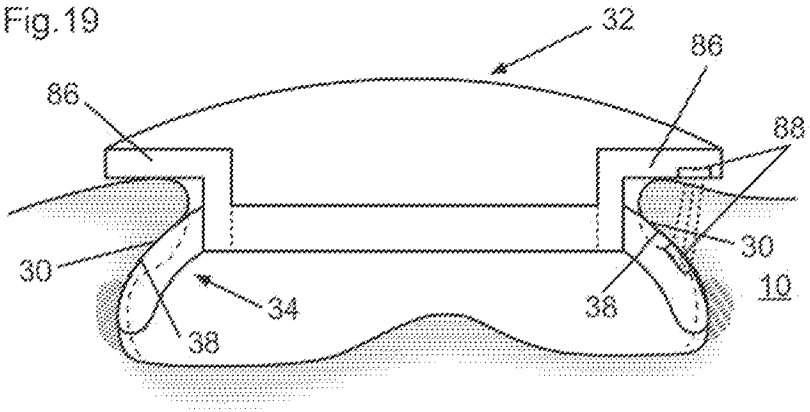
FIG. 19 illustrates a cross-sectional side view of yet another embodiment of the earpiece.

FIG. 19 and FIG. 20 illustrate alternative implementations of the movement-prevention member. In each one of the FIG. 19 and FIG. 20 embodiments of the earpiece 32, the movement-prevention member comprises an outward abutment portion 86. The outward abutment portion 86 is adapted to abut a portion of the ear 10 being opposite to the concha ceiling 30 when the earpiece 32 assumes a use position. Purely by way of example, the outward abutment portion 86 may be adapted to abut an outer part of the antihelix 20 of the ear when the earpiece assumes the use position.

As such, in each one of the FIG. 19 and FIG. 20 embodiments, a portion of the ear is squeezed or nipped between at least a portion of the outer skirt surface 38 and at least a portion of the outward abutment portion 86. This will in turn ensure that the earpiece 32 is kept in place such that the skirt edge 40 is prevented from contacting the concha floor 26.

Furthermore, the fact that a portion of the ear is squeezed or nipped between at least a portion of the outer skirt surface 38 and at least a portion of the outward abutment portion 86 makes it possible to determine useful information as regards the status, such as temperature or pulse, of the user of the earpiece 32. To this end, each one of FIGS. 19 and 20 illustrates that the embodiments of the earpieces 32 disclosed therein may comprise a sensor assembly 88. Purely by way of example, the sensor assembly may comprise a transmitter in or on the outward abutment portion 86 and a receiver in or on the positioning skirt portion 36, or vice versa.

Figure 21:
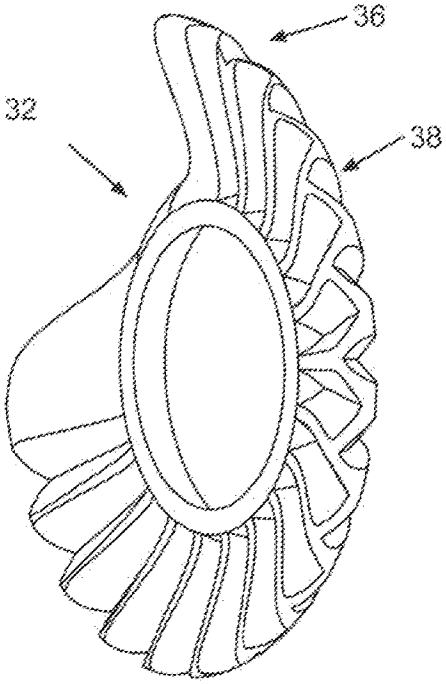
FIG. 21 illustrates a perspective view of another embodiment of the earpiece.

FIG. 21 illustrates another embodiment of the earpiece of the present disclosure wherein at least the outer skirt surface 38 is pleated. In fact, in the FIG. 21 embodiment, the positioning skirt portion corresponds to the peripheral skirt, which is pleated.

Optionally, a surface roughness of the outer skirt surface, as measured in a direction from the central axis to the skirt edge, is equal to or greater than 0.1 mm.

Figure 22:
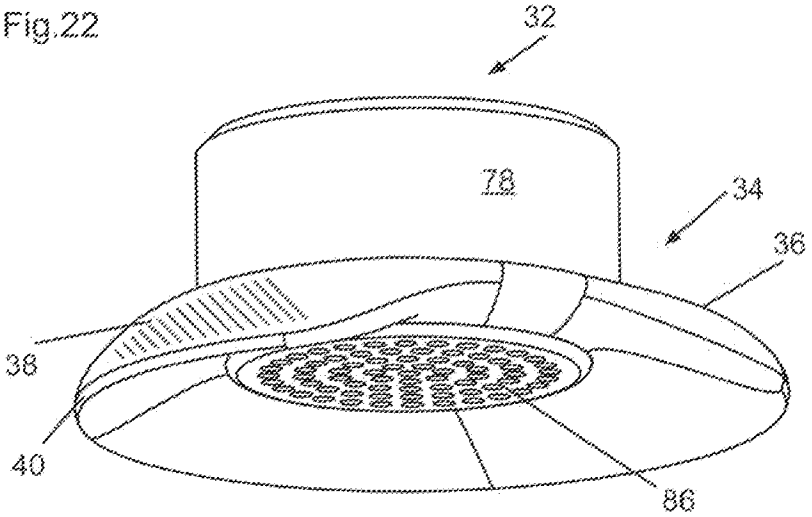
FIG. 22 illustrates a perspective view of a further embodiment of the earpiece.

Finally, FIG. 22 illustrates another embodiment of the earpiece 32 of the present disclosure wherein the earpiece 32 further comprises sound emitting means 86, preferably a loudspeaker. Purely by way of example, the sound emitting means may be accommodated in a housing 78 of the earpiece 32.

It is to be understood that the present disclosure is not limited to the embodiments described above and illustrated in the drawings; rather, the skilled person will recognize that many changes and modifications may be made within the scope of the appended claims. Purely by way of example, although embodiments of the earpiece 32 as presented hereinabove have been presented mainly in connection with sound emitting capabilities of the earpiece, it is also envisaged that the earpiece 32 according to the present disclosure may be used for other applications. Purely by way of example, embodiments of the earpiece 32 may be used as an earplug for protecting a user's ears from loud noises. As another non-limiting example, the earpiece 32 may comprise attachment means for connection to a sidepiece of a pair of glasses (not shown).

Furthermore, it is envisaged that the earpiece 32—for instance the housing thereof—may comprise electronic components in addition to components needed for sound emission. As a non-limiting example, embodiments of the earpiece 32 may comprise components for issuing or receiving wireless signals.

Finally, it is to be understood that the described properties of the earpiece are applicable to all embodiments of the earpiece which fall within the ambit of the appended claims.

The invention claimed is:

1. An earpiece for an ear, said ear comprising a concha cavity at least partially delimited by a concha floor, a concha side wall and a concha ceiling, wherein said concha side wall connects said concha floor to said concha ceiling, wherein the surface of said concha ceiling has a normal at least a component of which being directed towards said concha floor, said earpiece comprising a peripheral skirt comprising a positioning skirt portion which in turn comprises an outer skirt surface and an inner skirt surface, wherein a transition from said outer skirt surface to said inner skirt surface occurs at a skirt edge, wherein said skirt edge extends at least partially circumferentially around a central axis of said earpiece, wherein said earpiece is adapted to be moved to a use position, at least partially within said concha cavity, in a direction parallel to said central axis, during insertion of said earpiece into said ear, wherein, when said peripheral skirt is in a non-influenced condition, at least a portion of said inner skirt surface faces said central axis, said earpiece being such that said positioning skirt portion is adapted to assume said use position at least partially within said concha cavity whereby:

at least a portion of said outer skirt surface abuts at least a portion of said concha ceiling, said skirt edge is located closer to said concha floor than said outer skirt surface, and said skirt edge is spaced from said concha floor, wherein a skirt edge-free angular sector with its origin in said central axis is such that the angular sector is free from said skirt edge, said skirt edge-free angular sector having a skirt edge-free angular sector angle of at least 45°, wherein said skirt edge-free angular sector angle is smaller than or equal to 320°.

2. The earpiece according to claim 1, wherein, when said peripheral skirt is in said non-influenced condition, a projection of said peripheral skirt onto an plane, the normal of which coincides with said central axis, has an outer contour and wherein the central axis is located within said outer contour, said central axis being positioned such that a minimum difference is obtained between a largest distance and a smallest distance from said central axis to the outer contour, as measured in the plane, wherein said earpiece comprises a maximum contour point with a maximum distance in said plane from said central axis to said outer contour.

3. The earpiece according to claim 2, wherein an angular plane sector with its origin in said central axis is such that the angular plane sector is free from said peripheral skirt and/or that the distance from said central axis to each point of said outer contour in said angular plane sector is less than 85% of said maximum distance, said angular plane sector having an angular plane sector angle of at least 40°.

4. The earpiece according to claim 3, wherein a maximum contour point line extending from said central axis to said maximum contour point forms a smallest angle with a line defining said angular plane sector, said smallest angle being in the range of 0-15°.

5. The earpiece according to claim 2, wherein said earpiece comprises a proximal contour point with a proximal distance in said plane from said central axis to said outer contour, wherein a ratio between said maximum distance and said proximal distance is equal to or greater than 1.1.

6. The earpiece according to claim 5, wherein said outer contour is such that the distance from said central axis to said outer contour increases gradually from said proximal contour point to said maximum contour point.

7. The earpiece according to claim 5, wherein said outer contour further comprises an interim contour point wherein the distance from said central axis to said interim contour point is greater than said proximal distance but smaller than said maximum distance, wherein a largest angular segment with its origin in said central axis and which includes said maximum contour point, said proximal contour point and said interim contour point has an angle of at least 40°.

8. The earpiece according to claim 2, wherein a smallest circle that circumscribes said outer contour has a diameter within the range of 15-31 mm.

9. An earpiece for an ear, said ear comprising a concha cavity at least partially delimited by a concha floor, a concha side wall and a concha ceiling, wherein said concha side wall connects said concha floor to said concha ceiling, wherein the surface of said concha ceiling has a normal at least a component of which being directed towards said concha floor, said earpiece comprising a peripheral skirt comprising a positioning skirt portion which in turn comprises an outer skirt surface and an inner skirt surface, wherein a transition from said outer skirt surface to said inner skirt surface occurs at a skirt edge, wherein said skirt edge extends at least partially circumferentially around a central axis of said earpiece, wherein said earpiece is adapted to be moved to a use position, at least partially within said concha cavity, in a direction parallel to said central axis, during insertion of said earpiece into said ear, wherein, when said peripheral skirt is in a non-influenced condition, at least a portion of said inner skirt surface faces said central axis, said earpiece being such that said positioning skirt portion is adapted to assume said use position at least partially within said concha cavity whereby:

at least a portion of said outer skirt surface abuts at least a portion of said concha ceiling, said skirt edge is located closer to said concha floor than said outer skirt surface, and said skirt edge is spaced from said concha floor, wherein said positioning skirt portion comprises a distal portion adapted to be located farthest away from said concha floor, as seen along said central axis, when said positioning skirt portion assumes said use position, said positioning skirt portion extending at least partially from said distal portion to said skirt edge, wherein each one of two portions of said skirt edge, located on opposite sides of said central axis, is adapted to be deflected, relative to said distal portion, in a direction towards said central axis to thereby allow that said positioning skirt portion can be moved to said use position.

10. The earpiece according to claim 9, wherein a portion of said peripheral skirt is adapted to be elastically deformed such that the distance in said plane from said central axis to said outer contour of said portion can be elastically reduced by at least 5%.

11. An earpiece for an ear, said ear comprising a concha cavity at least partially delimited by a concha floor, a concha side wall and a concha ceiling, wherein said concha side wall connects said concha floor to said concha ceiling, wherein the surface of said concha ceiling has a normal at least a component of which being directed towards said concha floor, said earpiece comprising a peripheral skirt comprising a positioning skirt portion which in turn comprises an outer skirt surface and an inner skirt surface, wherein a transition from said outer skirt surface to said inner skirt surface occurs at a skirt edge, wherein said skirt edge extends at least partially circumferentially around a central axis of said earpiece, wherein said earpiece is adapted to be moved to a use position, at least partially within said concha cavity, in a direction parallel to said central axis, during insertion of said earpiece into said ear, wherein, when said peripheral skirt is in a non-influenced condition, at least a portion of said inner skirt surface faces said central axis, said earpiece being such that said positioning skirt portion is adapted to assume said use position at least partially within said concha cavity whereby:

at least a portion of said outer skirt surface abuts at least a portion of said concha ceiling, said skirt edge is located closer to said concha floor than said outer skirt surface, and said skirt edge is spaced from said concha floor, wherein said concha ceiling, which at least a portion of said outer skirt surface is adapted to abut when said positioning skirt portion assumes said use position, comprises a ceiling portion from at least one of the following portions of said ear: an antihelix, a tragus and an antitragus, preferably, said concha ceiling comprises a ceiling portion from said antihelix, wherein said earpiece is such that said positioning skirt portion is adapted to assume a use position at least partially within said concha cavity whereby, a first portion of said outer skirt surface abuts a ceiling portion of said antihelix, and a second portion of said outer skirt surface abuts a ceiling portion of said antitragus.

12. The earpiece according to claim 11, wherein said earpiece further comprises a housing, wherein said peripheral skirt at least partially circumscribes said housing.

13. The earpiece according to claim 12, wherein at least a portion of said skirt edge is adapted to be deflected, relative to said housing, in a direction towards said central axis to thereby allow that said positioning skirt portion can be moved to said use position.

14. The earpiece according to claim 13, wherein each one of two portions of said skirt edge, located on opposite sides of said central axis, is adapted to be deflected, relative to said housing, in a direction towards said central axis to thereby allow that said positioning skirt portion can be moved to said use position.

15. The earpiece according to claim 11, wherein said earpiece further comprises a movement-prevention member adapted to prevent said positioning skirt portion from moving relative to said concha floor to a position in which at least a portion of said skirt edge contacts said concha floor.

16. The earpiece according to claim 12, wherein said earpiece further comprises a movement-prevention member adapted to prevent said positioning skirt portion from moving relative to said concha floor to a position in which at least a portion of said skirt edge contacts said concha floor, wherein said housing comprises a concha floor abutment portion forming at least part of said movement-prevention member, said earpiece being such that said housing is adapted to assume a use position at least partially within said concha cavity in which said concha floor abutment portion abuts said concha floor, thereby preventing said skirt edge from contacting said concha floor.

17. The earpiece according to claim 15, wherein said movement-prevention member comprises an outward abutment portion, said outward abutment portion being adapted to abut a portion of said ear being opposite to said concha ceiling when said earpiece assumes a use position.

18. The earpiece according to claim 17, wherein said outward abutment portion is adapted to abut an outer part of the antihelix of said ear when said earpiece assumes said use position.

19. The earpiece according to claim 11, wherein a surface roughness of said outer skirt surface, as measured in a direction from said central axis to said skirt edge, is equal to or greater than 0.1 mm.

20. The earpiece according to claim 1, wherein said earpiece further comprises a loudspeaker.

* * * * *